US008152516B2

(12) United States Patent
Harvey et al.

(10) Patent No.: US 8,152,516 B2
(45) **Date of Patent: *Apr. 10, 2012**

(54) EQUINE DENTAL GRINDING APPARATUS

(75) Inventors: John B. Harvey, New London, WI (US); Travis J. Henry, Elkhorn, WI (US)

(73) Assignee: Flexi-Float, LLC, Spring Valley, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/942,324

(22) Filed: Sep. 15, 2004

(65) Prior Publication Data

US 2005/0214706 A1 Sep. 29, 2005

Related U.S. Application Data

(63) Continuation-in-part of application No. 10/719,572, filed on Nov. 22, 2003, now Pat. No. 7,172,415.

(51) Int. Cl.
*A61D 5/00* (2006.01)

(52) U.S. Cl. ..... 433/1; 433/130

(58) Field of Classification Search ..... 433/1, 116, 433/125, 126, 130, 134
See application file for complete search history.

(56) References Cited

U.S. PATENT DOCUMENTS

| | | | | |
|---|---|---|---|---|
| 575,407 | A | 1/1897 | Wirsching | |
| 670,086 | A | 3/1901 | Stanbrough | |
| 741,519 | A | 10/1903 | Mahaffy | |
| 854,955 | A | 5/1907 | Martin | |
| 994,483 | A | 6/1911 | Sklar | |
| 1,151,197 | A | 8/1915 | Lang | |
| 2,442,033 | A | 5/1948 | Brantly et al. | |
| 4,722,685 | A | 2/1988 | de Estrada | |
| 5,851,111 | A | 12/1998 | Long et al. | |
| 5,888,064 | A | 3/1999 | Stubbs | |
| 6,273,712 | B1 | 8/2001 | Rach et al. | |
| 7,029,274 | B1 * | 4/2006 | Capps | 433/1 |
| 7,033,169 | B2 * | 4/2006 | Furney | 433/1 |
| 7,101,176 | B1 * | 9/2006 | Capps | 433/1 |
| 7,172,415 | B2 * | 2/2007 | Harvey et al. | 433/1 |
| 7,238,021 | B1 * | 7/2007 | Johnson | 433/1 |
| 2003/0228552 | A1 * | 12/2003 | Dipietro | 433/1 |

FOREIGN PATENT DOCUMENTS

| | | | |
|---|---|---|---|
| CH | 252232 | | 10/1948 |
| DE | 30-02-386 | A1 | 7/1981 |
| DE | 3002386 | * | 7/1981 |
| DE | 3002386 | A1 * | 7/1981 |
| FR | 1.052.653 | | 1/1954 |
| FR | 2775585 | | 9/1999 |
| GB | 838501 | | 6/1960 |
| JP | 9075379 | | 3/1997 |

OTHER PUBLICATIONS

Makita Corporation, "Cordless Equine Rasp", Instruction Manual for Models 4399D and 4399DW, Jan. 22, 1993, Makita Corporation, Anjo, Aichi, Japan, 12 pages.

Milwaukee Electric Tool Corporation, "Heavy Duty Cordless Reversing Screwdriver with Adjustable Clutch", Care and Operating Instructions, Publication Date Unknown, Milwaukee Electric Tool Corporation, Brookfield, Wisconsin, USA, 3 pages.

* cited by examiner

*Primary Examiner* — Ralph Lewis
(74) *Attorney, Agent, or Firm* — Boardman & Clark LLP; Joseph W. Byrne

(57) ABSTRACT

An apparatus for grinding the teeth of horses is disclosed. The apparatus includes a tool body. A drive shaft is disposed inside of the tool body. A drive mechanism is connected to one end of the drive shaft. A grinding member is connected to the other end of the drive shaft. The grinding member can pivot through a range of angles relative to the drive shaft.

55 Claims, 26 Drawing Sheets

EQUINE DENTAL GRINDING APPARATUS

This application is a continuation-in-part application of prior U.S. patent application Ser. No. 10/719,572 now U.S. Pat. No. 7,172,415, filed Nov. 22, 2003.

FIELD OF THE INVENTION

The present invention relates generally to a dental apparatus for use with animals. More specifically, it relates to a power equine dental apparatus for floating (grinding) the teeth of horses.

BACKGROUND OF THE INVENTION

Many animal species, in addition to humans, require dental work from time-to-time. One such species is the equine species (e.g., horses). A horse's teeth erupt continuously though out its lifetime. The continuous eruption of a horse's teeth cause the teeth to wear unevenly. Irregularities in the horse's teeth often develop as a result of this uneven wear. These irregularities can take the form of spikes or sharp projecting edges. These irregularities must be removed. If not removed, they can cause the horse to experience difficulty in chewing and/or can damage the soft tissues on the inside of the horse's mouth such as the cheeks and tongue.

Generally, veterinarians remove these irregularities through a procedure called "floating." In common terms, "floating" involves "filing," "grinding," or "rasping" the horse's teeth. Devices for floating a horses teeth are well known in the prior art. They range from hand-held manual floats and files to power floating devices having rotating or reciprocating grinding bits or pads.

Manual filing of a horses teeth can be a tiring and time consuming procedure. As a result, power floating devices have been developed to make floating a horse's teeth easier and more efficient. Such prior art power devices include the devices disclosed in U.S. Pat. No. 4,722,685 which issued on Feb. 2, 1988 to de Estrada; U.S. Pat. No. 5,851,111 which issued on Dec. 22, 1998 to Long et al.; U.S. Pat. No. 5,888,064 which issued on Mar. 30, 1999 to Stubbs; and U.S. Pat. No. 6,273,712 which issued on Aug. 14, 2001 to Rach et al.

Each of the prior art power floating devices disclosed above includes an elongated tool body or shaft. The elongated tool body is generally provided to allow the veterinarian to reach deep inside of the horse's mouth. At or near one end of the elongated tool body is the grinding bit or surface. At or near the other end is a handle or grip for holding the device.

The elongated tool body of each of these prior art devices is straight and rigid. Having the grinding bit disposed at the end of a long, straight, and rigid tool body can be problematic. This is because it limits the maneuverability of the power tool inside of the horse's mouth.

For example, it is common for tooth irregularities to be present in the very back of the horse's mouth. In many cases, it is difficult to get at these irregularities. This is because other structures inside of the horse's mouth, such as the horse's other teeth or cheeks, may be in the way. To properly float these teeth, therefore, the veterinarian must maneuver around these other structures. This often requires the veterinarian to approach these teeth at an angle.

Similarly, it is often desirable to actually place an angle on the surface of a horse's tooth. Thus, the veterinarian often approaches a particular tooth at an angle not because access is limited, but simply because an angled surface is the desired result.

Approaching teeth inside of a horse's mouth at an angle using the prior art devices disclosed above often requires the veterinarian to hold the straight, rigid, elongated tool body of these prior art devices at an angle. Holding these prior art devices at an awkward angle can be extremely tiring for the veterinarian.

In addition, it may not even be possible to achieve the required angle of attack using the prior art devices. This is because during the floating procedure, the horses mouth is held open. If the angle needed to reach or grind a particular tooth is too great, the various structures of the horses open mouth, such as the lips or other teeth, will come into contact with the elongated tool body of the prior art devices and prevent the veterinarian from achieving the angle necessary to reach or properly grind the tooth requiring attention. This is especially true for teeth that reside deep in the horse's mouth.

It is desirable, therefore, to have a power floating apparatus that allows the veterinarian to grind teeth at various angles relative to the longitudinal axis of the elongated tool body while maintaining the elongated tool body in a horizontal or substantially horizontal position. Likewise, it is desirable to have a power floating device that will permit the veterinarian to reach teeth deep in the horse's mouth at an angle while maintaining the elongated tool body in a horizontal or substantially horizontal position, thus possibly avoiding interference with other structures in the horse's mouth. Preferably, the power dental tool will have an adjustable grinding end such that the grinding bit or surface can be angled relative to the longitudinal axis of the elongated tool body.

Another problem with floating a horse's teeth is the need to remove the enamel dust that results from the grinding process. This dust can make it very difficult for the veterinarian to see inside of the horse's mouth. It is desirable, therefore, to have a system for vacuuming up the enamel dust that is produced by floating a horse's teeth. Preferably, the vacuum system will be integrated into the dental power tool and will provide suction in and around the grinding bit or grinding surface.

Finally, because many of the teeth that require floating are deep inside of the horses mouth, visibility may be limited. It is desirable, therefore, to also have a source of light available to the veterinarian. Preferably, the source of light will be integrated into the dental power tool and will provide adequate light in the vicinity of the tooth to be ground.

SUMMARY OF THE PRESENT INVENTION

According to a first aspect of the invention, an equine dental apparatus for floating the teeth of horses includes a tool body, a drive shaft and a grinding member. The drive shaft is disposed inside of the tool body and includes a first end configured for attachment to a drive mechanism. The grinding member is connected to the second end and is partially housed in the tool body. The grinding member is capable of pivoting through a range of angles relative to the drive shaft in this embodiment.

Other principal features and advantages of the invention will become apparent to those skilled in the art upon review of the following drawings, the detailed description and the appended claims.

BRIEF DESCRIPTION OF THE DRAWINGS

The drawings, which constitute a part of the specification, are as follows.

Figure 1:
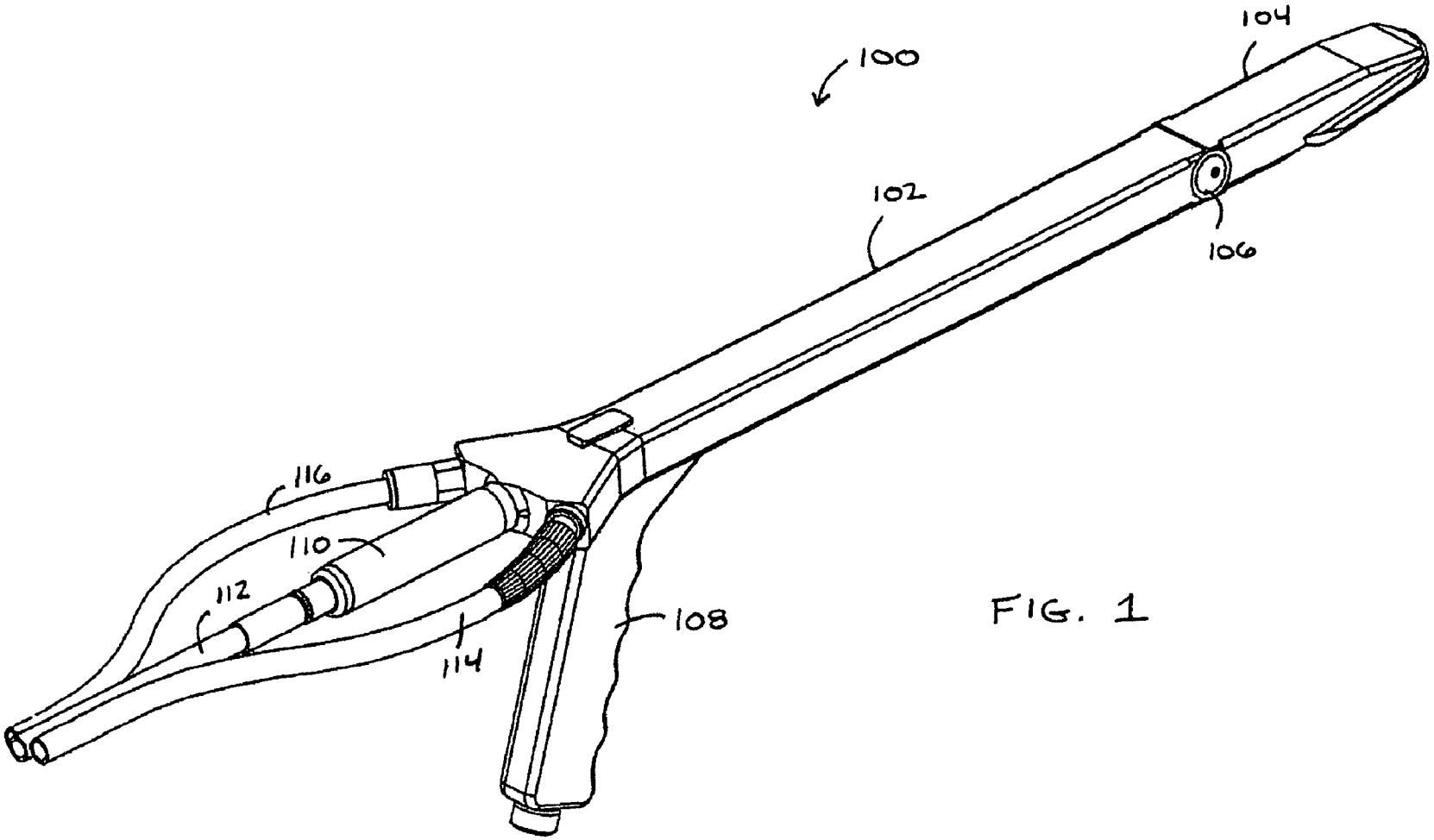
FIG. 1 is an isometric top-side view of a power equine dental tool according to one embodiment of the present invention.

Before explaining at least one embodiment of the present invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to a particular apparatus having a particular configuration and particular features, the present invention is not limited to this configuration or to these features and other configurations and other features can be used. Also, although the present invention will be illustrated with reference to an equine dental apparatus, the present invention is not necessarily limited to usage with the equine species and may have application with other species as well.

Generally, the present invention involves an apparatus for floating (e.g., grinding, filing or rasping) the teeth of horses. The apparatus is elongated to reach deep into the horse's mouth. An adaptor for connecting the apparatus to an external drive mechanism such as a variable speed motor is disposed at one end (the drive end) of the apparatus. A drive shaft is connected to the adaptor and runs through the center of the apparatus defining a longitudinal axis for the apparatus. A grinding bit or bur is disposed at or near the other end (the grinding end) of the apparatus and is connected to the drive shaft. A pivot joint is disposed between the drive end and the grinding end of the drive shaft and separates the drive shaft into two sections. The pivot joint allows the section of the drive shaft on the grinding, end of the tool and the grinding bit to pivot at various angles relative to the longitudinal axis. Thus, the elongated body of the apparatus remains horizontal or substantially horizontal while at the same time, the grinding bit or bur is angled relative to the elongated tool body. The grinding end of the dental tool can be adjusted through a range of angles in one embodiment to allow for the grinding of teeth in various locations.

A handle is attached near the drive end of the dental tool to allow the dental veterinarian to hold the apparatus. The handle is reversible in one embodiment of the present invention such that it can be attached to the top or bottom of the elongated tool to allow for grinding both the upper and lower teeth.

The apparatus also includes a vacuum system in one embodiment for vacuuming up enamel dust that is produced during the floating procedure. Vacuum ports run the entire length of the apparatus. An external vacuum system is connected to the rear end of the apparatus opposite the grinding bit. The vacuum ports open up, one on either side of the grinding bit, to provide suction for vacuuming up the enamel dust and material that is produced during the floating procedure.

The apparatus includes a source of illumination in another embodiment. Light source cable ports run the entire length of the apparatus from the rear end of the apparatus to the bit end. Fiber optic cables are disposed inside of the light source cable ports. An external source of light is connected to the internal light source cable at the rear end of the apparatus. The light source cable ports open up, one on either side of the grinding bit, to provide light from the light source to the tooth being floated.

An equine dental power tool 100 (also referred to herein as a dental floating tool) according to one embodiment of the present invention is shown in FIG. 1. Dental power tool 100 includes an elongated tool body comprised of a tool body assembly 102, a bit housing assembly 104, and a pivot joint 106. Dental tool 100 also includes a pistol grip handle 108 and an angle locking handle 110. In addition, FIG. 1 also shows a flexible drive cable 112, an external light source cable 114, and a vacuum system hose 116 attached to dental power tool 100.

Bit housing assembly 104 (also called bit head 104) is attached to the front end (also referred to as the pivot end, the grinding end or the bit end) of tool body assembly 102 via pivot joint 106. This allows bit housing assembly 104 to pivot upwards and downwards relative to tool body assembly 102. Pistol grip handle 108 and angle locking handle 110 are disposed at or near the rear end (also referred to as the drive end or accessory mounting end) of dental tool 100. Pistol grip handle 108 is positioned at or near the balance point of dental tool 100 to increase the maneuverability and reduce fatigue on the operator of the tool. Angle locking handle 110 is attached to the drive end of dental tool 100 and provides a means for locking bit housing assembly 104 at a desired angle relative to tool body assembly 102.

Figure 14:
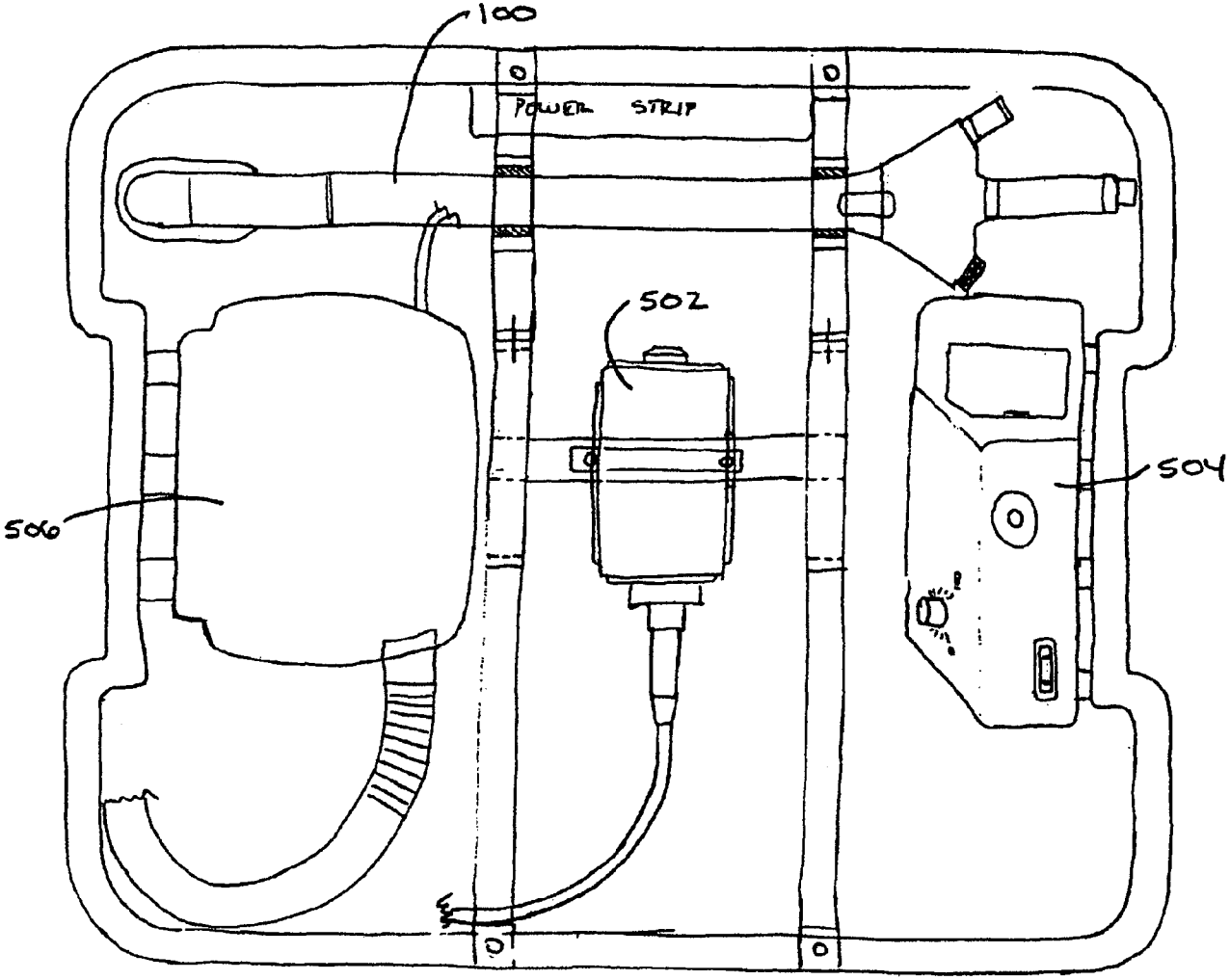
FIG. 14 is a top plan view of a modular equine dental grinding system according to another embodiment of the present invention.

Drive cable 112, external light source cable 114, and vacuum system hose 116 are also all attached to the drive end of dental tool 100. Drive cable 112 in this embodiment is a flexible drive cable that is connected between dental tool 100 and an external drive mechanism or system 502 such as a variable speed electric motor (see FIG. 14). One such drive system that can be used is the Series S flexible shaft power tool supplied by The Foredom Electric Company of Bethel, Connecticut.

External light source cable 114, which in the embodiment of FIG. 1 is a fiber optic cable, is connected between dental tool 100 and an external light source 504 such as the Fiber-Lite® MI-150 Illuminator manufactured by Dolan-Jenner Industries of Lawrence, Mass. or the ECO-150 180 Watt Fiber Optic Illuminator manufactured by Applied Scientific of Tigard, Oreg. Vacuum hose 116 is connected between dental tool 100 and an external vacuum system 506.

In should be understood that the present invention is not limited to the particular drive mechanism, light source or vacuum system disclosed herein and in other embodiments, other mechanisms, sources and systems are used. It should also be understood that although the invention shown in FIG. 1 includes a vacuum system and a light source, other embodiments of the present invention may include only one or the other of these accessories or may not include either of these accessories or may include other accessories as well.

Figure 2:
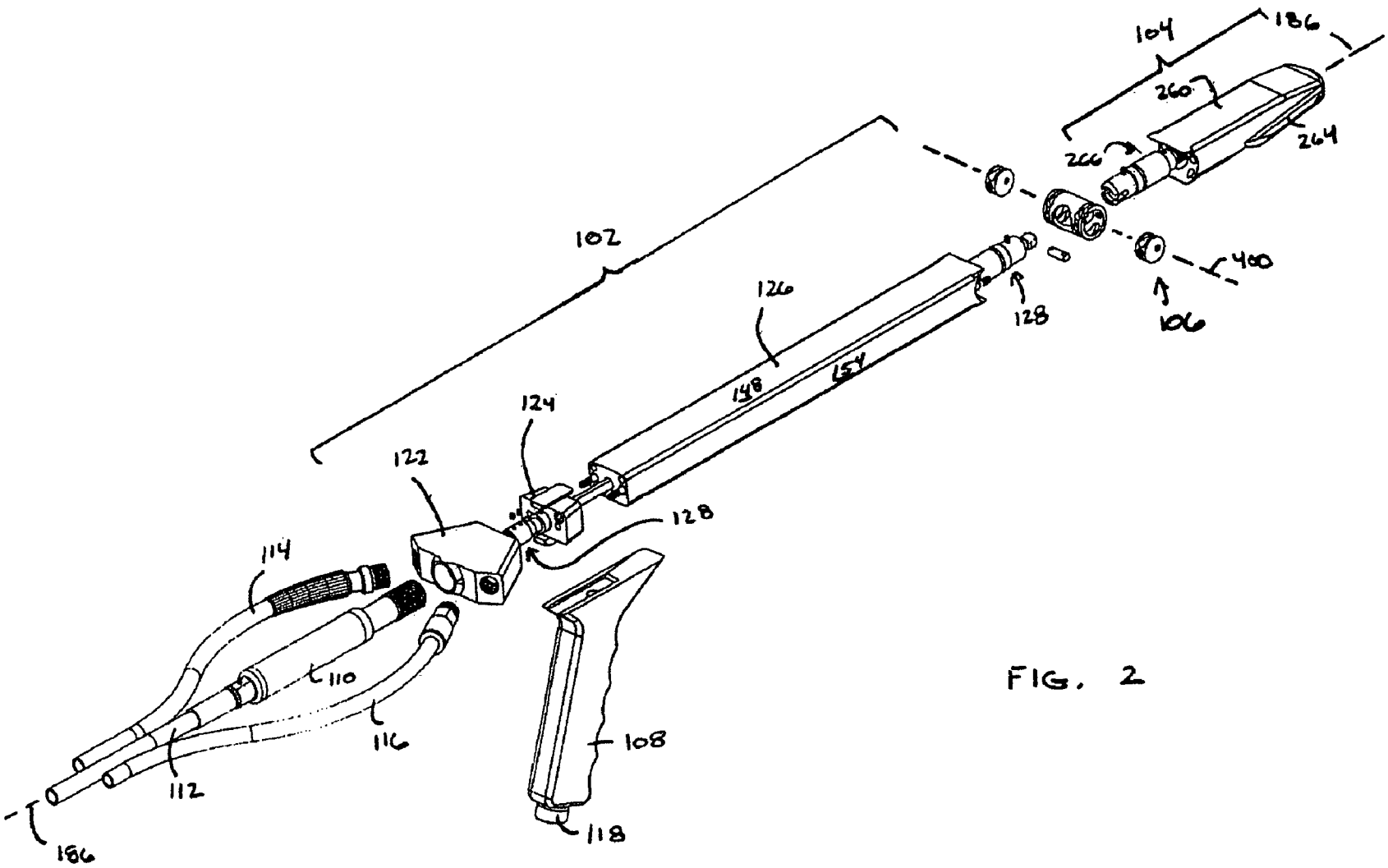
FIG. 2 is an exploded isometric top-side view of a power equine dental tool according to another embodiment of the present invention.
Figure 3:
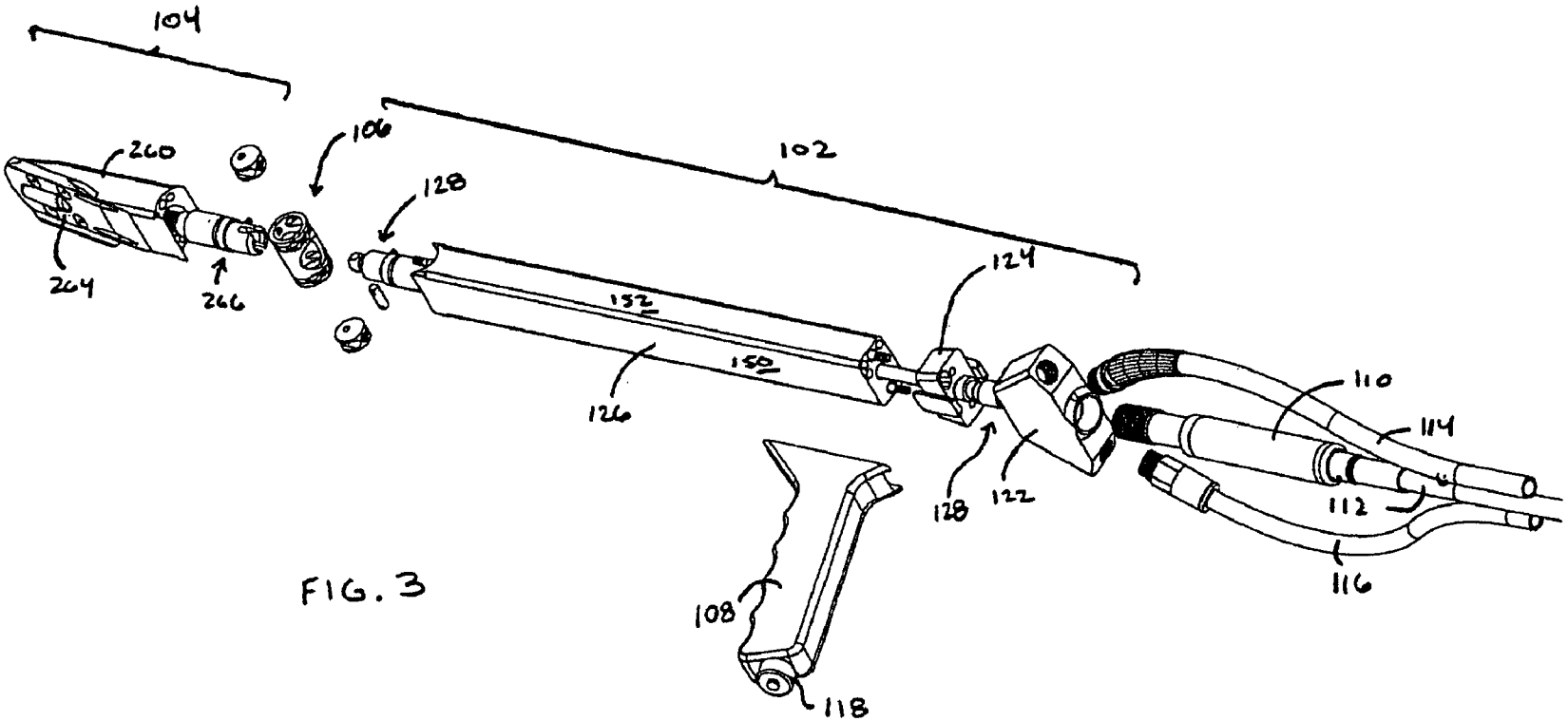
FIG. 3 is an exploded isometric bottom-side view of the power equine dental tool of FIG. 2.
Figure 6:
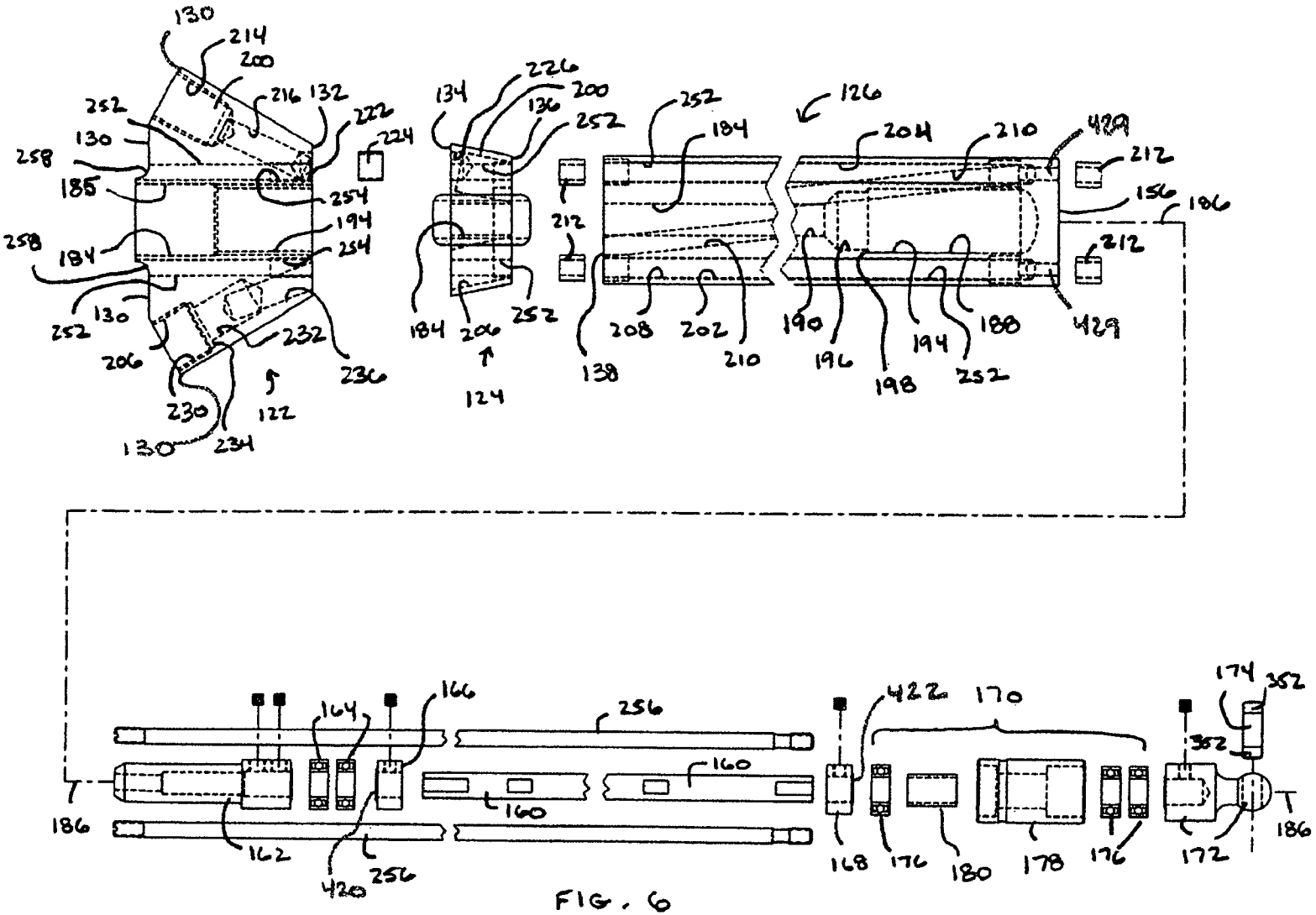
FIG. 6 is an exploded bottom plan view of the tool body assembly of the power equine dental tool of FIG. 2.

Tool body assembly 102, as best shown in FIGS. 2, 3 and 6, is comprised of an accessory mounting block 122, a handle mounting block 124 (also referred to herein as the vacuum manifold), a tool body 126, and a drive shaft assembly 128. Although tool body assembly 102 as shown in these figures includes several different component parts, the present invention is not limited to these particular components or to the particular configuration of these components. Other embodiments of the present invention may not have these same components or may have other components in addition to the components shown in these figures.

Figure 4:
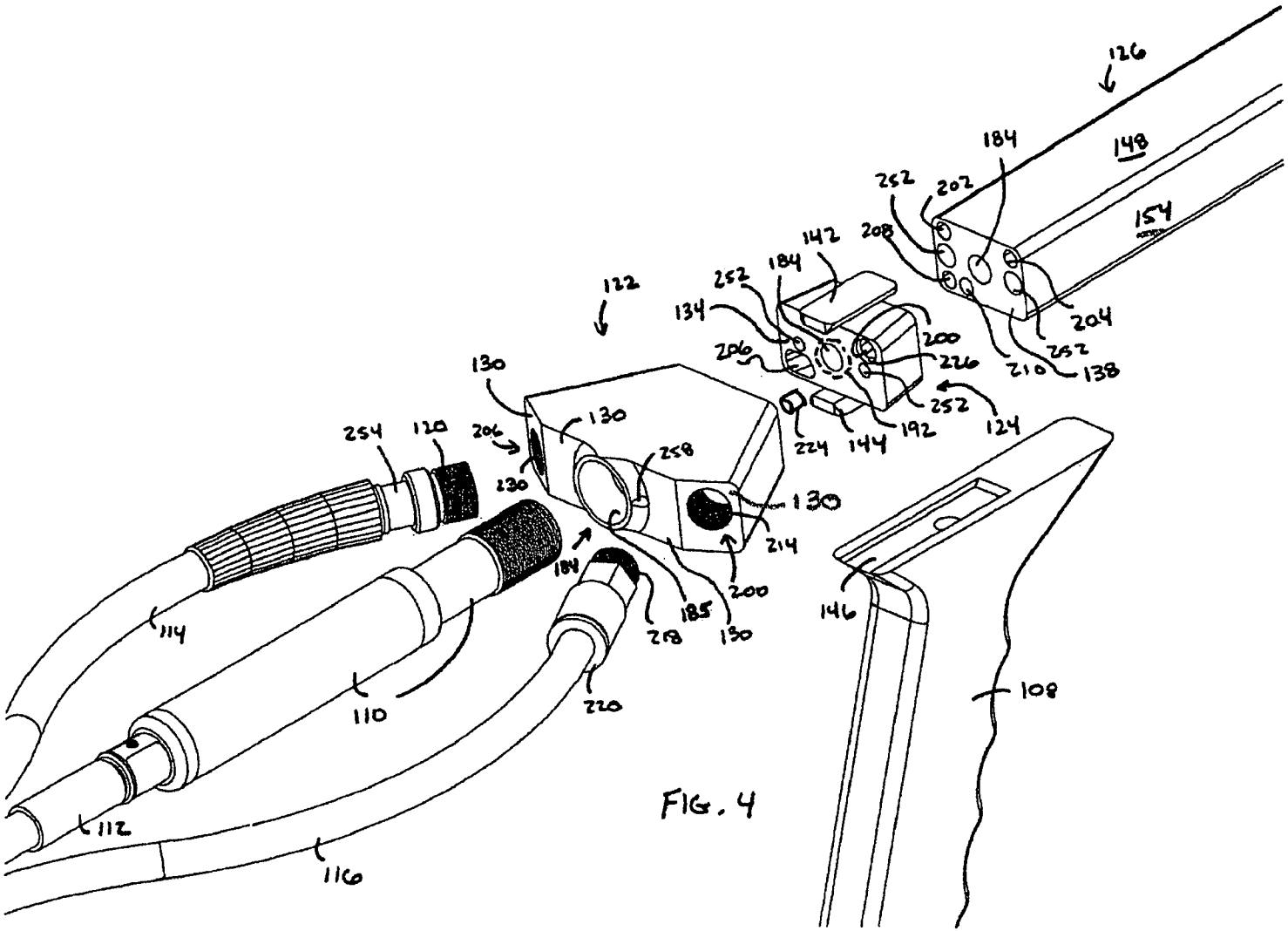
FIG. 4 is an exploded isometric close-up top-side view of the drive end of the power equine dental tool of FIG. 2 as viewed from the drive end of the power equine dental tool.
Figure 5:
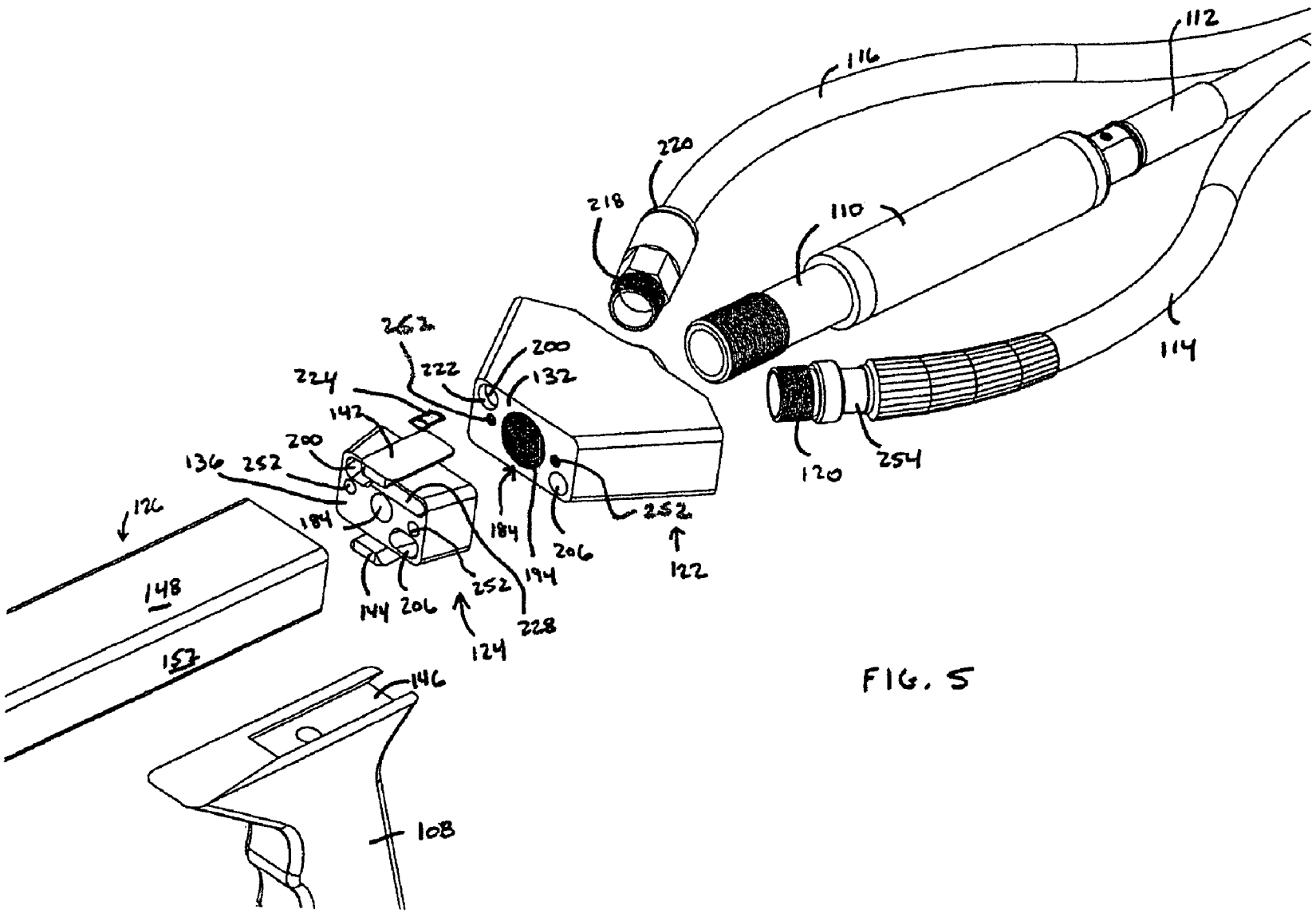
FIG. 5 is an exploded isometric close-up top-side view of the drive end of the power equine dental tool of FIG. 2 as viewed from the bit end of the power equine dental tool.

Accessory mounting block 122, which is disposed at the drive end of dental tool 100, includes a rear accessory mounting surface 130 and a front flat mating surface 132 (see FIGS. 4 and 5). Accessory mounting surface 130 is multi-faceted and configured for connection to the drive system and the various accessories (e.g., vacuum system, light source) that can be used with dental tool 100.

Handle mounting block 124 includes a rear flat mating surface 134 that mates flush against, and is complimentary to, front flat mating surface 132 of accessory mounting block 122 and a front flat mating surface 136 opposite rear flat mating surface 134. In addition, handle mounting block 124 also includes a pair of handle mounting flanges 142, 144. One of the handle mounting flanges is disposed on the top of handle mounting block 124 and the other handle mounting flange is disposed on the bottom of handle mounting block 124.

Flanges 142, 144 in this embodiment are dovetail flanges. In other embodiments, a T-bar is used as the mounting flange and a T-slot is included on pistol grip handle 108 as the mating surface.

Pistol grip handle 108 includes a complimentary groove 146 that mates with flanges 142 and 144. This allows pistol grip handle 108 to be mounted on the bottom side of dental tool 100 when dental tool 100 is used for floating a horse's lower teeth and on the top side of dental tool 100 when it is used to float the upper teeth in a horse's mouth. Pistol grip handle 108 can be locked in place on one of the mounting flanges by turning locking knob 118 (see FIGS. 2 and 3).

Tool body 126 (see FIGS. 4, 5 and 6) includes a top surface 148, a bottom surface 150, and a pair of opposing side surfaces 152, 154. The rear end or drive end of tool body 126 includes a flat mating surface 138 that is complimentary to, and mates flush against, front flat mating surface 136 of handle mounting block 124. The other end 156 of tool body 126, the pivot end (also referred to as the grinding end or the bit end), is a coped end having a concave curved end surface 140 (see FIG. 7). Curved surface 140 in the embodiment shown in the figures is semi-circular in shape and is provided to slidably engage with pivot joint 106 thereby allowing bit housing assembly 104 to pivot with respect to tool body assembly 102 as will be described more fully below. A pair of alignment ridges 429 are disposed on concave curved surface 140 to aid in aligning tool body 126 with pivot joint 106. These ridges are received in complimentary recesses on pivot joint 106.

Figure 11:
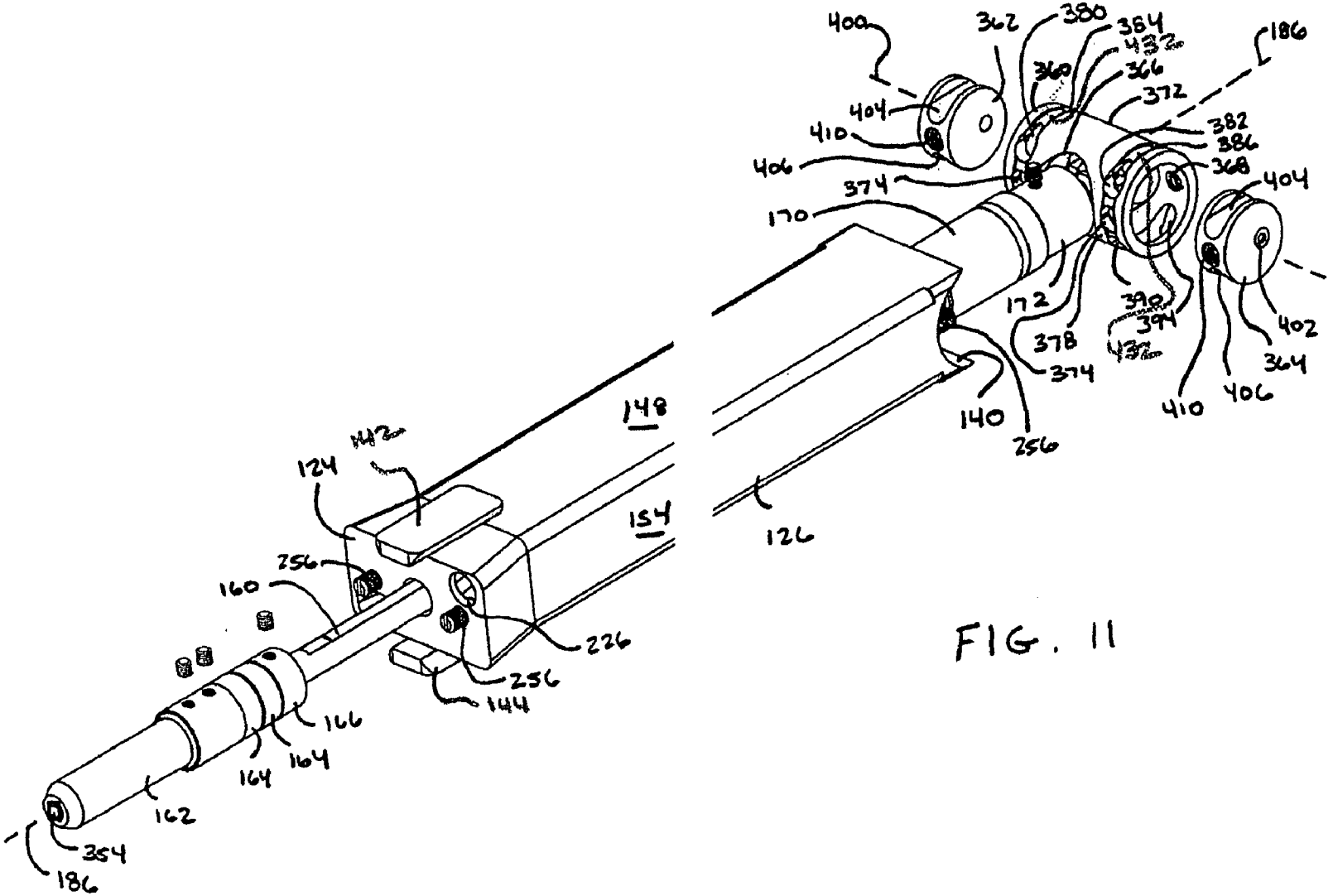
FIG. 11 is an exploded isometric close-up top-side view of the drive shaft assembly of the power equine dental tool of FIG. 2 as viewed from the drive end of the power equine dental tool.
Figure 12:
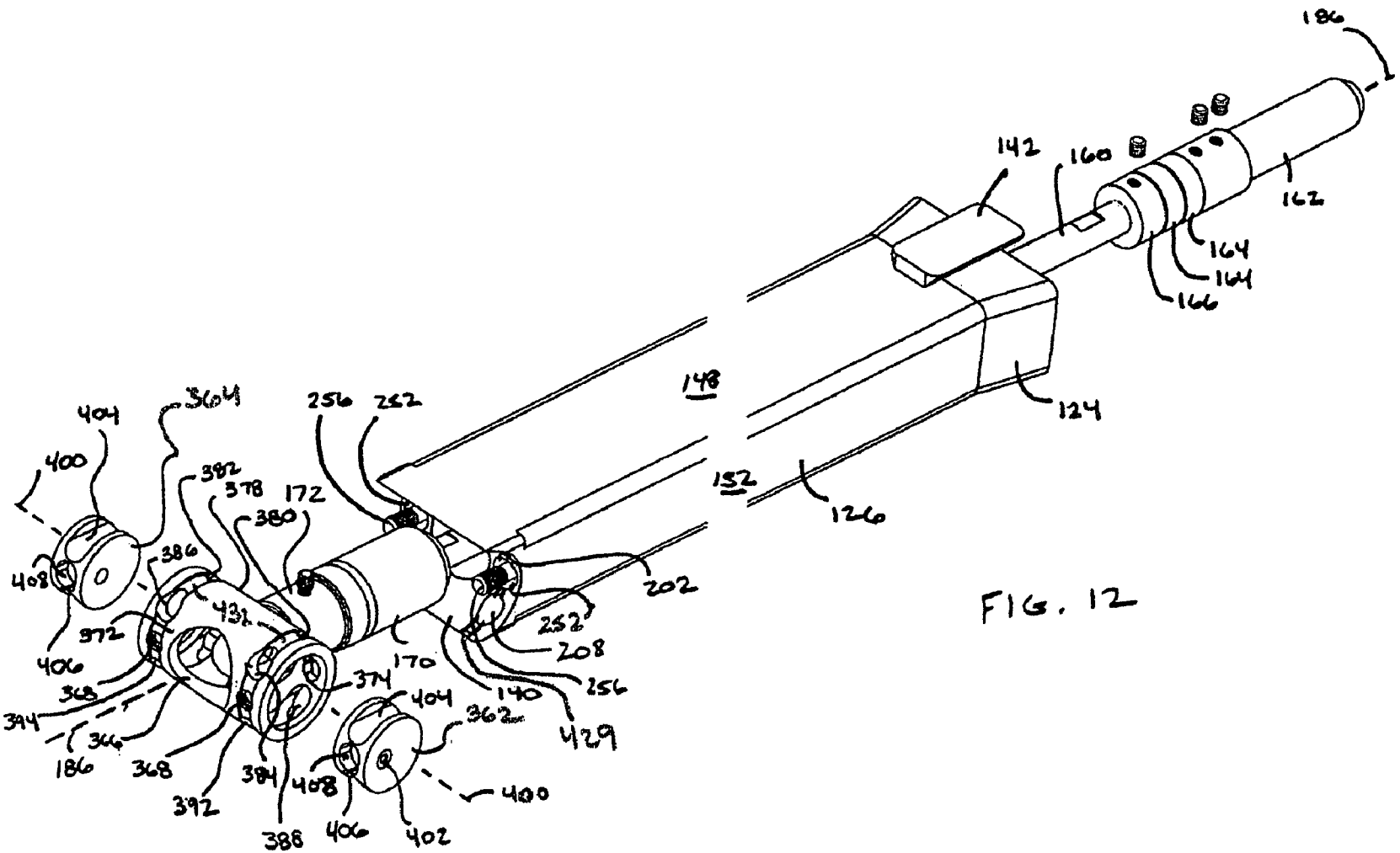
FIG. 12 is an exploded isometric close-up top-side view of the bit end of the power equine dental tool of FIG. 2 as viewed from the bit end of the power equine dental tool.

Drive shaft assembly 128 as best shown in FIGS. 6, 11 and 12 includes a drive shaft 160, a drive cable adaptor 162, a pair of sealed ball bearings 164, a first bearing retaining collar 166, a second bearing retaining collar 168, a bearing subassembly 170, and a drive ball 172. Drive cable adaptor 162 and bearings 164 are mounted on the rear end or drive end of drive shaft 160. Drive ball 172 and bearing subassembly 170 are mounted on the other end (e.g., the front end or pivot end) of drive shaft 160.

Drive cable adaptor 162 is mounted to the end of drive shaft 160 using a pair of set screws (in an alternative embodiment, a spring pin is used to secure drive cable adaptor 162 to the end of drive shaft 160). The end of drive cable adaptor 162 includes a square open receptacle 354 that is configured to mate with a complimentary mating swedged square adaptor (not shown) on the end of drive cable 112. Rotational motion is thereby transferred from the drive system to drive shaft 160 by way of the connection to drive cable adaptor 162.

Drive ball 172 is attached to the opposite end of drive shaft 160 (e.g., the pivot end) using either a set screw or a spring pin. Drive ball 172 includes a drive pin 174 that freely rotates inside of a hole drilled through the center of drive ball 172 at ninety (90) degrees to longitudinal axis 186. Drive ball 172 and drive pin 174 engage with a drive socket of bit housing assembly 104 to transmit rotational motion from drive shaft 160 to the grinding bit or bur as will be described below.

Bearings 164 and bearing subassembly 170 are disposed on drive shaft 160 to permit drive shaft 160 to rotate freely inside of tool body assembly 102. Sealed ball bearings 164 are disposed side-by-side on drive shaft 160 between drive cable adaptor 162 and bearing retaining collar 166. Bearing retaining collar 166 is secured to drive shaft 160 using a set screw or spring pin.

Bearing subassembly 170 is disposed in a similar manner near the other end of drive shaft 160 adjacent to drive ball 172. Bearing subassembly 170 includes three sealed ball bearings 176 disposed inside of a bearing housing 178. Two of the ball bearings are disposed side-by-side in bearing housing 178 and are separated from the third ball bearing by a bearing spacer 180. Bearing assembly 170 is held in place on drive shaft 160 by bearing retaining collar 168 on one side and by drive ball 172 on the other side. Bearing retaining collar 168 is also secured to drive shaft 160 using a set screw or spring pin.

Drive shaft assembly 128 is installed inside of a drive shaft opening 184 and is disposed along, and rotates or spins about, a longitudinal axis 186 of dental tool 100. Drive shaft opening 184 runs the entire length of tool body assembly 102 through accessory mounting block 122, handle mounting block 124 and tool body 126. Drive shaft opening 184 is configured to house drive shaft assembly 128 and includes a drive end section 185 disposed inside of accessory mounting block 122, a bearing support section 188 located at the pivot end of tool body 126, and a smaller central section 190 disposed between the two end sections 185, 188. The central section 190 of drive shaft opening 184 passes through both handle mounting block 124 and a portion of tool body 126.

Drive end section 185 of drive shaft opening 184 includes a threaded inner section 194 (See FIG. 5). The front end of angle locking handle 110, which inserts into drive end section 185, is threaded and engages with threaded inner section 194. Drive cable adaptor 162 and bearings 164 are housed inside of angle locking handle 110 when drive shaft assembly 128 is installed inside of drive shaft opening 184.

The diameter of drive end section 185 passing through accessory mounting block 122 is greater than the diameter of central section 190 passing through handle mounting block 124. A locking shoulder 192 (see FIG. 4) is thereby formed around drive shaft opening 184 at the mating interface between accessory mounting block 122 and handle mounting block 124. It should be noted that bit housing assembly 104 can be locked in place at a desired angle by threading angle locking handle 110 completely into drive end section 185 until it abuts up against locking shoulder 192 on flat mating surface 134. The locking procedure will be described more fully below.

Bearing support section 188 of drive shaft opening 184 includes a first section 194 configured to receive bearing subassembly 170 and a second adjoining section 196 which is configured to accommodate bearing retaining collar 168. A shoulder 198 is formed between sections 194 and 196. Bearing subassembly 170 is lightly press fit into bearing support section 188 with its rearward end abutting up against shoulder 198 when drive shaft assembly 128 is installed inside of drive shaft opening 184.

In addition to drive shaft opening 184, tool body assembly 102 also includes a pair of vacuum ports or passageways 202, 204 and a pair of light source cable ports or passageways 208, 210. The vacuum ports are disposed to deliver vacuum suction to bit housing assembly 104. The light source cable ports are likewise disposed inside of tool body assembly 102 to deliver a source of illumination to bit housing assembly 104.

Each of the pair of ports mentioned above actually start out as a single port or opening in accessory mounting block 122 and then divide into a pair of ports or openings inside of tool body 126. For example, accessory mounting block 122 and handle mounting block 124 include a single vacuum port 200 that passes through from rear surface 130 of accessory mounting block 122 through to front mating surface 136 of handle mounting block 124. At the mating interface between handle mounting block 124 and tool body 126, vacuum port 200, through a slotted opening 228, interfaces with vacuum ports 202, 204 that run the entire length of tool body 126 to provide suction to bit housing assembly 104. Thus in this embodiment, handle mounting block 124 also acts as a vacuum manifold in that it feeds a pair of vacuum ports 202, 204 at its output from a single vacuum input port.

Vacuum port 200 includes a threaded hole 214 at its input that is drilled part way through accessory mounting block 122 from rear surface 130 and a second smaller diameter un-threaded hole 216 drilled part way through accessory mounting block 122 from front mating surface 132 (see FIG. 6). Threaded hole 214 and un-threaded hole 216 meet at an angle inside of accessory mounting block 122 to form a complete vacuum port passageway through accessory mounting block 122.

A vacuum hose adaptor (or connector) 218 is threaded into threaded input hole 214 and is configured to mate with a complimentary adaptor 220 on the end of vacuum hose 116 (shown attached to vacuum hose 116 in FIGS. 4 and 5). A small round recess 222 is reamed out on front mating surface 132 around un-threaded hole 216 to accommodate a small vacuum seal tube or sleeve 224. Vacuum seal tube 224 helps insure vacuum integrity when dental tool 100 is in use as will be described more fully below.

Vacuum port 200 enters handle mounting block 124 from accessory mounting block 122 through a small round hole 226 in rear mating surface 134. Hole 226 is also provided to receive vacuum seal tube 224 when handle mounting block 124 is mated with accessory mounting block 122. As vacuum port 200 passes through handle mounting block 122, it opens up into a larger slotted opening 228 that runs across the entire front mating surface 136 of handle mounting block 124 (see FIG. 5). Slotted opening 228 is configured to provide, vacuum suction from a single port, namely vacuum port 200, to both vacuum ports 202, 204 of tool body 126. Thus, what starts out as a single vacuum port in accessory mounting block 122, divides into a pair of vacuum ports in tool body 126.

As mentioned above, vacuum port 200 is in vacuum communication with round vacuum ports 202, 204 of tool body 126. Vacuum ports 202, 204 run parallel with each other along the entire length of tool body 126 from rear mating surface 138 to curved pivot mating surface 140. Each vacuum port 202, 204 is disposed inside of tool body 126 adjacent to top surface 148 with one of the vacuum ports disposed adjacent to one side 152 of tool body 126 and the other vacuum port disposed adjacent to the opposite side 154 of tool body 126.

Like the vacuum ports that are disposed inside of tool body assembly 102, the light source cable ports also start out as a single port on the drive end or accessory mounting end of tool body assembly 102 and branch out into a pair of light source cable ports 208, 210 inside of tool body 126. More specifically, accessory mounting block 122 and handle mounting block 124 include a single light source cable port 206 that passes from rear surface 130 of accessory mounting block 122 through to front mating surface 136 of handle mounting block 124. At the mating interface between handle mounting block 124 and tool body 126, light source cable port 206 is in open communication with the pair of round light source cable ports 208, 210 that run the entire length of tool body 126.

The input portion of light source cable port 206, like vacuum port 200, is formed from two intersecting drilled holes, one of which is drilled from accessory mounting surface 130 and the other from front mating surface 132 of accessory mounting block 122. The input hole drilled from accessory mounting surface 130 is comprised of a first threaded outer section 230 that extends part way into accessory mounting block 122 and a smaller diameter un-threaded inner section 232 which is disposed adjacent to outer threaded section 230 (see FIG. 6). A shoulder 234 is formed between the inner and outer sections 230, 232 as a result of the differences in diameter of the two sections. Hole 236 is drilled from front mating surface 132 and intersects hole 232 at an angle inside of accessory mounting block 122 to provide a complete light source cable passageway through accessory mounting block 122.

Light source cable port 206 passes from accessory mounting block 122 directly through handle mounting block 124 from rear mating surface 134 to front mating surface 136. It should be noted that the portion of light source cable port 206 located in handle mounting block 124 is not round, but rather is an irregular shaped oblong opening configured to provide access to the pair of internal round light source cable ports 208, 210 of tool body 126.

Light source cable ports 208, 210 are each disposed inside of tool body 126 adjacent to bottom surface 150 and each port runs the entire length of tool body 126. Unlike vacuum ports 202, 204 however, light source cable ports 208, 210 are not parallel with each other. Rather, each of the two light source cable ports start out adjacent the same side 152 of tool body 126 and then diverge away from each other. Light source cable port 208, for example, is disposed inside of tool body 126 adjacent to side 152 over the entire length of tool body 126. Light source cable port 210 on the other hand, crosses over from side 152 to the opposite side 154 of tool body 126. In other words, although the two light source cable ports start out in the lower half of tool body 126 on the same side 152 of tool body 126 at rear mating surface 138, they diverge from each other such that at the coped pivot end 156 of tool body 126, each light source cable port opens up adjacent opposite sides of tool body 126.

Figure 13:
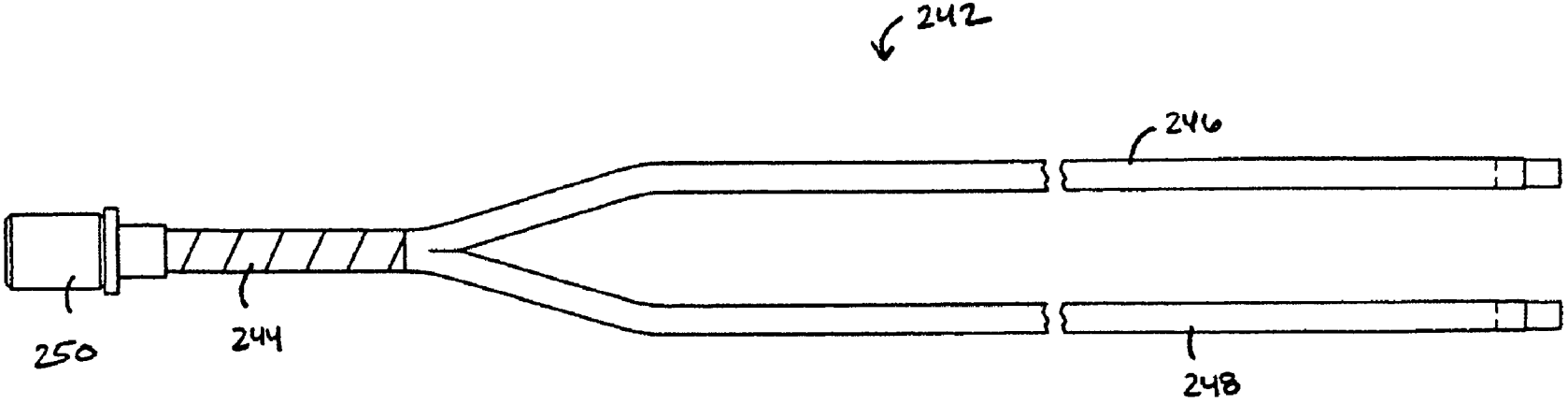
FIG. 13 is a plan view of an internal light source cable according to one embodiment of the present invention.

The various light source cable ports 206, 208, 210 of tool body assembly 102 are configured to receive an internal split-end light source cable 242 (see FIG. 13). Light source cable 242 is a fiber optic cable in this embodiment and includes a single non-split input cable 244 that splits into a pair of split output cables 246, 248. An adaptor or connector 250 is attached to the input end of light source cable 242.

It should be noted that the present invention is not limited to the use of fiber optics as the source of illumination. In alternative embodiments of the present invention, other light source cables are used. For instance, in one other embodiment, a gel filled cable is used as the light source. In another embodiment, light bulbs or LEDs are provided as the source of illumination at the bit end of the dental tool and copper wires are strung through the various light source cable ports to provide power to the bulbs or LEDs.

When installed into dental tool 100, non-split input cable 244 resides inside of light source cable port 206 while split cables 246, 248 are disposed inside of light source cable ports 208, 210. Adaptor 250 resides inside of threaded input hole 230 and abuts up against shoulder 234. A retaining collar 120 (shown attached to external light source cable 114 in FIGS. 4 and 5) threads into input hole 230 to hold adaptor 250 in place. Adaptor 250 is configured to mate with a light source cable adaptor 254 which is disposed on the end of external light source cable 114. Adaptor 254 simply plugs into adaptor 250 in this embodiment.

In addition to the various openings and ports thus far described, tool body assembly 102 also includes a pair of round holes 252 that run the entire length of tool body assembly 102. Each hole 252 runs parallel with longitudinal axis 186 on either side of drive shaft opening 184 and is configured to receive a draw rod 256. An oillube bushing 212 is press fit into the open ends of each draw rod hole 252 in tool body 126 to support the draw rods.

Each draw rod 256 is threaded on its ends. The ends of each draw rod 256 are threaded in opposite directions however. Thus, for example, the rear or drive end of each draw rod 256 includes a right-hand thread and the other end (the pivot end) of each draw rod includes a left-hand thread. In addition, the drive end of each draw rod is slotted at its end to receive the end of a slotted screwdriver (in alternative embodiments, other end configurations are used including a hex socket, a cross point socket, a torx socket, etc. . . . ).

As previously mentioned, each draw rod hole 252 extends the entire length of tool body assembly 102 including through accessory mounting block 122. Draw rods 256, however, only extend a short distance into accessory mounting block 122 from front flat mating surface 132. Each draw rod hole 252 thus includes a threaded section 254 (see FIG. 5) in the vicinity of front flat mating surface 132 to engage with the threaded drive end of a draw rod 256. Screwdriver access to the slot on the drive end of each draw rod 256 is provided from accessory mounting surface 130 through the open end 258 of each draw rod hole 252.

Bit housing assembly 104 will now be described in detail. Bit housing assembly 104 as shown in FIGS. 7,8, 9 and 10 includes a bit housing 260, a grinding member 262, a bit guard 264, and a bit drive shaft assembly 266. Grinding member 262 is a steel shanked carbide bit in this embodiment. Bit 262 is partially disposed inside of bit housing 260. Bit guard 264 is attached to the underside of bit housing 260 and is disposed around grinding bit 262. The bit end (front end) of bit drive shaft assembly 266 is attached to grinding bit 262. The other end (e.g., the pivot end) of bit drive shaft assembly 266 is configured to interface with the pivot end of drive shaft assembly 128.

Bit housing 260 includes a tapered front end 268 and a coped pivot joint end 270. The front end 268 of bit housing 260 is tapered to allow for easier maneuverability of dental tool 100 in the horse's mouth. The front end 268 of bit housing 260 is rounded and all of the exposed outer edges of bit housing 260 are radiused. This is done to reduce the possibility of damage to the horse's soft mouth tissues during the floating procedure.

The coped pivot end 270 of bit housing 260 includes a concave curved surface 274 which allows bit housing assembly 104 to mate with pivot joint 106. A pair of longitudinally oriented mounting holes 276 are disposed on either side of bit housing 260. These mounting holes are disposed to receive a pair of mounting screws 278 that attach bit housing 260 to pivot joint 106. A pair of alignment ridges 431 are disposed on concave curved surface 274 to aid in aligning bit housing 260 with pivot joint 106. These ridges are received in a pair of complimentary recesses that are disposed on pivot joint 106.

Figure 10:
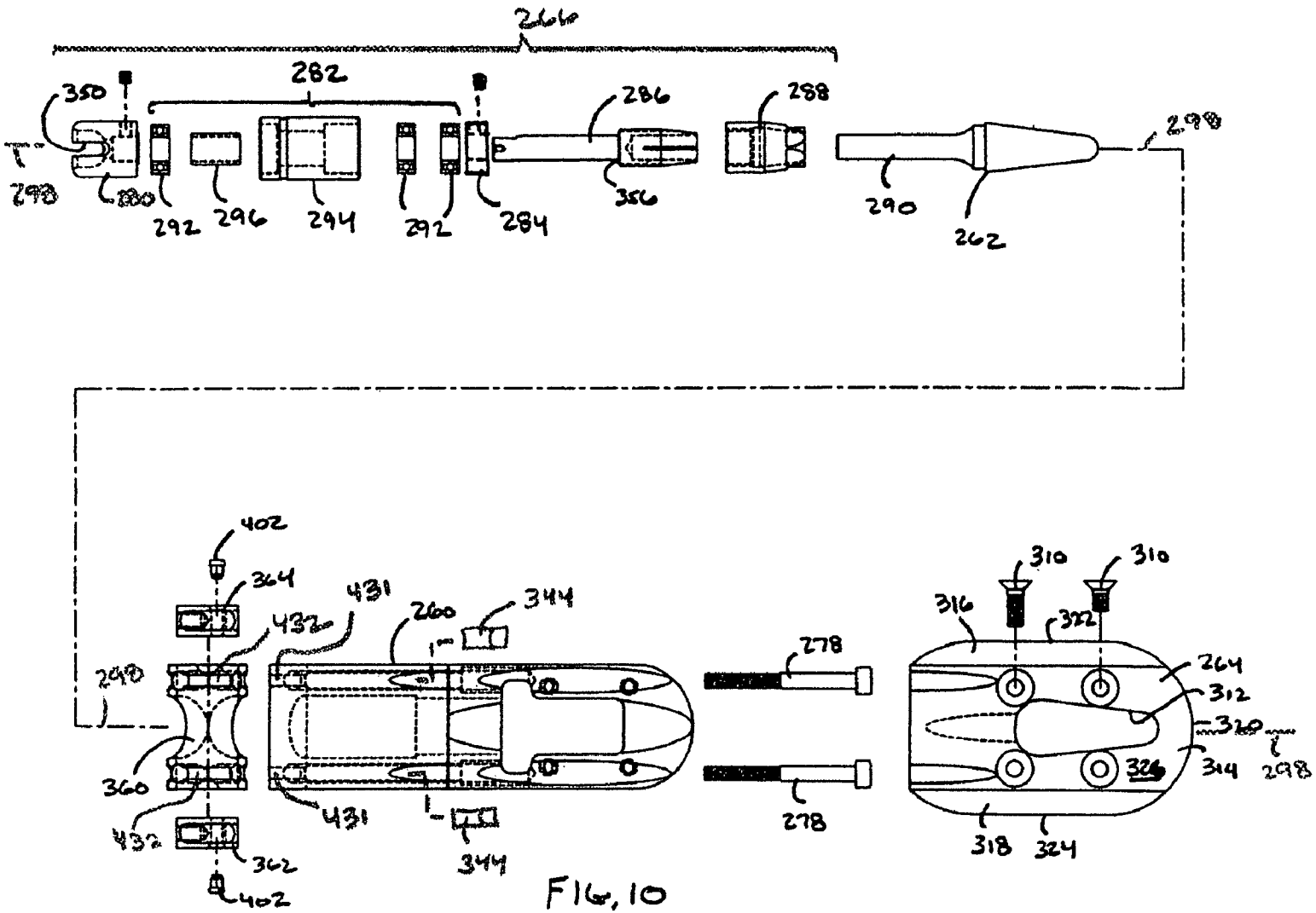
FIG. 10 is an exploded bottom plan view of the bit housing assembly and pivot joint of the power equine dental tool of FIG. 2.

Bit drive shaft subassembly 266 as shown in FIG. 10 includes a drive socket 280, a bearing subassembly 282, a collet shaft 286, and a collet nut 288. Bit 262 includes a bit shaft 290 that inserts into collet shaft 286 and is secured to collet shaft 286 using collet nut 288. Drive socket 280 is attached to the other end of collet shaft 286 using a small set screw or spring pin that engages with collet shaft 286.

Bearing subassembly 282 is disposed on collet shaft 286 adjacent to drive socket 280. Bearing subassembly 282 includes three sealed ball bearings 292 disposed inside of a bearing housing 294. Two of the ball bearings are disposed side-by-side in bearing housing 294 and are separated from the third ball bearing by a bearing spacer 296. In one embodiment, bearing assembly 282 is held in place on collet shaft 286 by shoulder 356 of collet shaft 286 on one side and by drive socket 280 on the other side. In an alternative embodiment, a bearing retaining collar 284 is used to secure bearing assembly 282 in place next to drive socket 280.

Figure 15A:
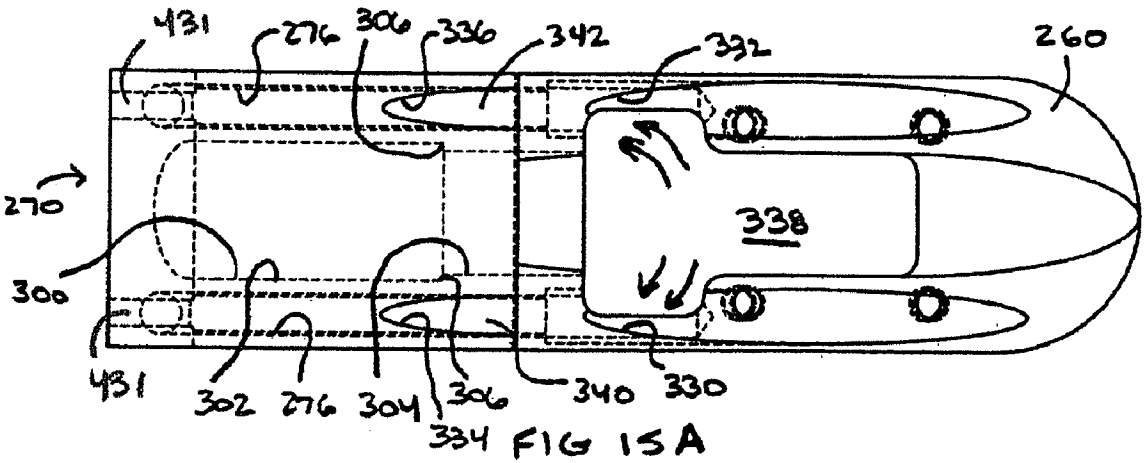
FIG. 15A is a bottom plan view of a bit housing according to one embodiment of the present invention.
Figure 15B:
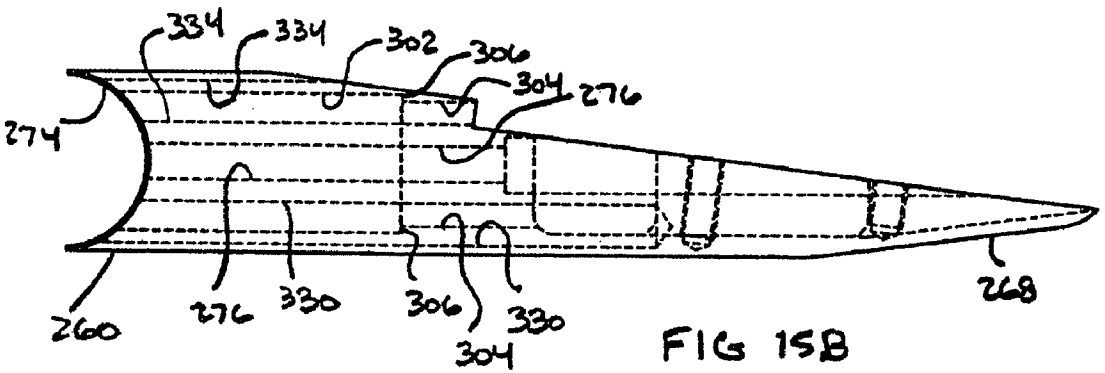
FIG. 15B is a side plan view of the bit housing of FIG. 15A.
Figure 15C:
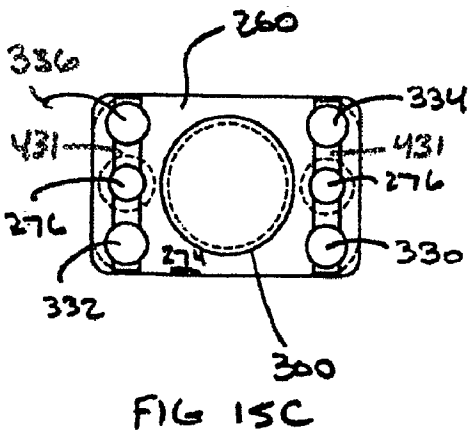
FIG. 15C is a rear end plan view of the bit housing of FIG. 15A.

Bit drive shaft subassembly 266 is housed in a bit drive shaft opening 300 (see FIGS. 15A-C) disposed inside of bit housing 260 and is disposed along, and rotates or spins about, a longitudinal axis 298 of bit housing assembly 104. Bit drive shaft opening 300 is comprised of a larger diameter bearing support section 302 and an adjoining smaller diameter section 304. A shoulder 306 is formed between the two sections 302, 304 and provides a stop for bit drive shaft subassembly 266 when it is fully inserted into bit drive shaft opening 300.

More specifically, when bit drive shaft subassembly 266 is properly installed inside of bit drive shaft opening 300, bearing subassembly 282 is lightly press fit into bearing support section 302 with its forward end abutting up against shoulder 306. In this position, bit 262, which is attached to the end of bit drive shaft subassembly 266, extends outward from the front end of bit drive shaft opening 300 and drive socket 280 extends outward from the pivot end of bit drive shaft opening 300.

Bit guard 264 is attached to the under side of bit housing 260 using four small mounting screws 310. Bit 262 protrudes through a central opening 312 in bit guard 264. Thus, bit housing 260 provides a complete cover or shield on the top side of bit 262 as bit 262 rotates while bit guard 264 provides a partial shield around bit 262 on the under side of bit housing 260 as bit 262 rotates.

Bit guard 264, like bit housing 260, includes many features that are designed to prevent damage to the soft tissues of the horse's mouth. For example, the front end 314 of bit guard 264 is curved and, along with sides 316, 318 of bit guard 264, extends outward from bit housing 260. In addition, the outer exposed edges 320, 322, 324 formed on front end 314 and sides 316, 318 respectively of bit guard 264 are radiused to eliminate the sharp edges that might otherwise be present around the outer perimeter of bit guard 264.

In addition to the safety features described above, sides 316, 318 of bit guard 264 are actually thicker than is the interior portion 326 of bit guard 264. The thicker sides allow for a larger radius to be placed on edges 322, 324 which in turn makes these edges even duller than they otherwise would be if the thickness of sides 316, 318 was reduced. This in turn further reduces the likelihood of damage to the horse's mouth during the floating procedure.

It should be noted that the present invention does not necessarily require any or all of the safety features described herein. Other embodiments of the present invention, for example, may include only some of these features or may not include any of these features. Likewise, other embodiments of the present invention may include other safety features not described herein.

Bit housing 260 (see FIGS. 15A-C), like tool body 126, includes a pair of vacuum ports 330, 332 and a pair of light source cable ports 334, 336. These various ports all run longitudinally through bit housing 260 and are disposed in-line and in open alignment with the corresponding vacuum and light source cable ports that exit coped pivot end 156 of tool body assembly 102 when equine dental tool 100 is completely assembled. For example, vacuum suction actually passes from vacuum ports 202, 204, through pivot joint 106, and into vacuum ports 330, 332 respectively to provide vacuum suction to bit housing assembly 104. In a similar manner, split light source cables 246, 248 pass from light source cable ports 208, 210, through pivot joint 106, and into light source cable ports 334, 336 to provide a source of light to the bit end of dental tool 100.

Looking at bit housing 260, it can be seen that vacuum ports 330, 332 open into a small vacuum chamber 338 that is formed around grinding bit 262 by bit housing 260 and bit guard 264. Vacuum suction is provided in and around the vicinity of grinding bit 262 (in the direction of the arrows shown in FIG. 15A) to suction up any enamel dust that is produced during the floating procedure.

The open ends 340, 342 of each light source cable port 334, 336 terminate at a point rearward of grinding bit 262 on either side of grinding bit 262. Unlike vacuum ports 330, 332, however, the open ends of light source cable ports 334, 336 are disposed on the outside of bit guard 264, not on the inside.

A clear lens 344 is installed in each open end 340, 342 of light source cable ports 334, 336 to prevent water or moisture from entering the light source cable ports. Lenses 344 are made from clear plastic acrylic rod that is sawed to the desired length and then machined to provide flat end and angled surfaces. Each lens is then vapor polished to restore the clearness that is lost during the sawing and machining process.

When properly installed, each split light source cable 246, 248 terminates near the open end 340, 342 of its respective light source cable port 334, 336 just behind a lens 344. Thus, light from the ends of light source cables 246, 248 is provided from the open ends 340, 342 of light source cable ports 334, 336 through a lens 344 and shines on grinding bit 262 and on to the tooth being floated. Bit guard 264 is preferably made from a light colored material, such as a white plastic material, to further reflect the light onto the tooth being floated.

Figure 7:
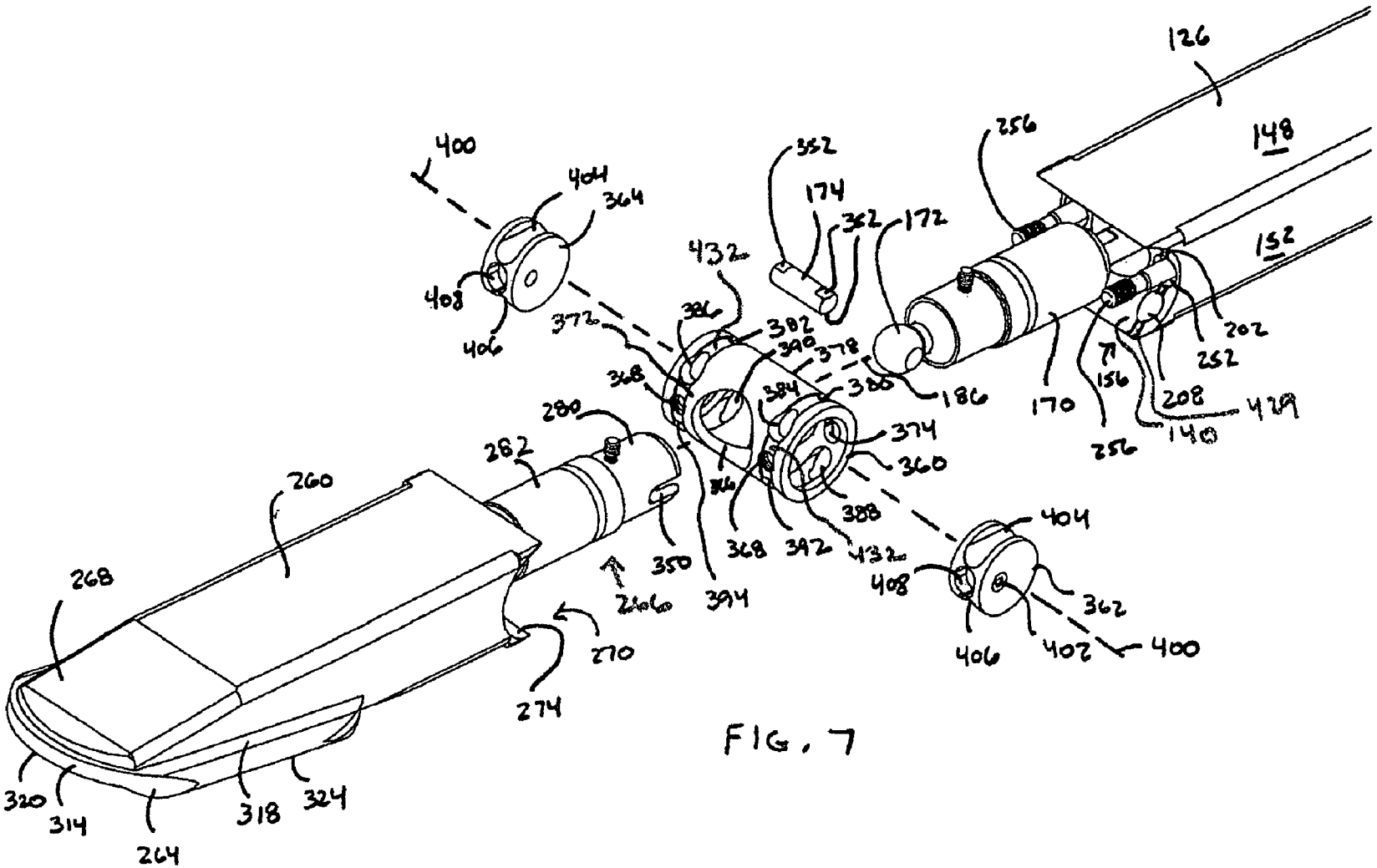
FIG. 7 is an exploded isometric close-up top-side view of the bit end of the power equine dental tool of FIG. 2 as viewed from the bit end of the power equine dental tool.
Figure 8:
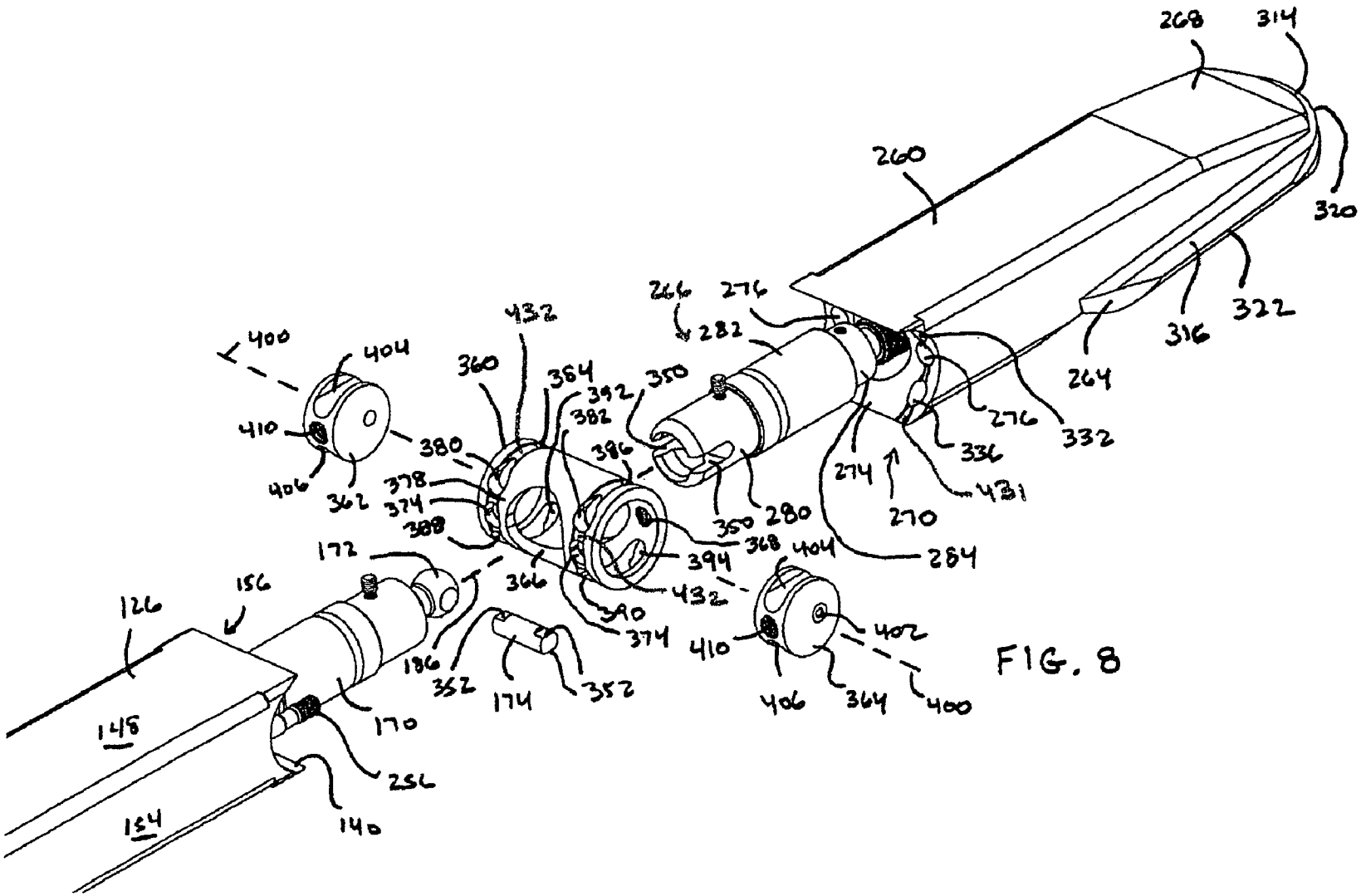
FIG. 8 is an exploded isometric close-up top-side view of the bit end of the power equine dental tool of FIG. 2 as viewed from the drive end of the power equine dental tool.
Figure 9:
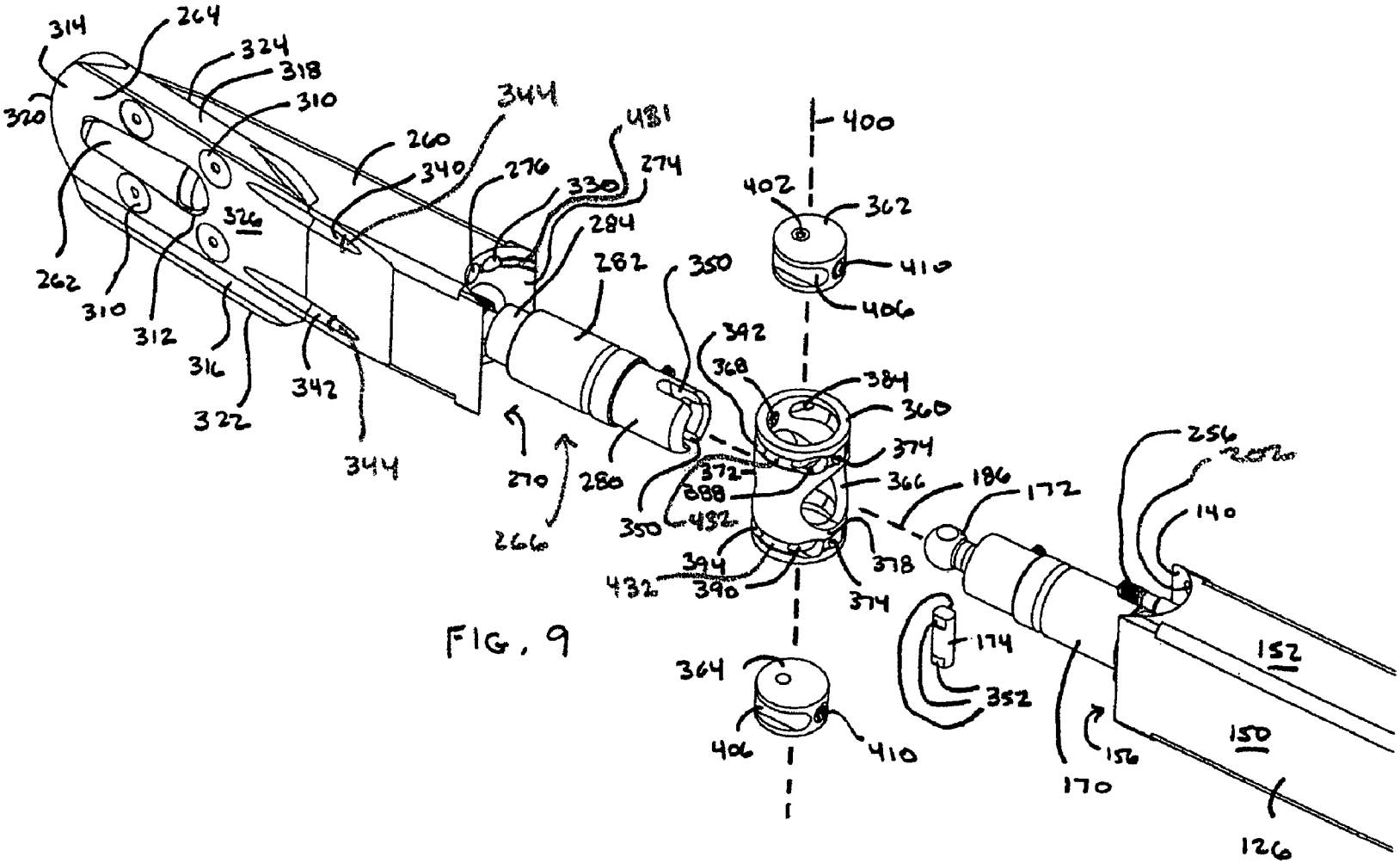
FIG. 9 is an exploded isometric close-up bottom-side view of the bit end of the power equine dental tool of FIG. 2 as viewed from the drive end of the power equine dental tool.

FIGS. 7, 8, and 9 show a detailed view of pivot joint 106. Pivot joint 106 includes a hollow cylindrical pivot tube 360 and a pair of pivot tube discs or nuts 362, 364 rotatably mounted inside of pivot tube 360. The concave pivot end surface 140 of tool body 126 also makes up a part of pivot joint 106. Pivot tube 360, when installed inside of dental tool 100, pivots or rotates about a pivot axis 400 that is perpendicular to longitudinal axis 186 of dental tool 100.

Pivot tube 360 includes a central drive joint opening 366 for receiving drive ball 172 and drive socket 280. A pair of threaded fastener receiving holes 368 are disposed on the front radial or circumferential surface 372 (the outer radial surface nearest bit housing 260) of pivot tube 360, one on either side of central drive joint opening 366. Mounting screws 278 pass through holes 276 in bit housing 260 and are threaded into threaded holes 368 to fixedly attach pivot tube 360 to bit housing 260 and thereby also to bit housing assembly 104.

In addition to central drive joint opening 366 and threaded holes 368, pivot tube 360 also includes a pair of oblong slotted draw rod or fastener openings 374 on its rear radial or circumferential surface 378 (the outer radial surface nearest tool body 126). Slotted draw rod openings 374 are disposed one on either side of central drive joint opening 366 and are provided to allow each draw rod 256 to pass through pivot tube 360 and into a corresponding pivot tube nut 362 or 364 which are rotatably disposed inside of pivot tube 360.

A pair of slotted vacuum port openings 380, 382 are provided on rear circumferential surface 378. These slotted vacuum port openings are disposed on either side of, and slightly above, central drive joint opening 366. A corresponding second pair of slotted vacuum port openings 384, 386 are present on front circumferential surface 372 and are disposed in-line with slotted vacuum port openings 380, 382 respectively.

It should be noted that slotted vacuum port openings 380 and 384 are disposed on pivot tube 360 such that they are in-line and in open alignment with vacuum port 202 in tool body 126 and vacuum port 330 in bit housing 260. Similarly, slotted vacuum port openings 382 and 386 are disposed on pivot tube 360 such that they are in-line and in open alignment with vacuum port 204 in tool body 126 and vacuum port 332 in bit housing 260. Thus, each of the slotted vacuum port openings is disposed to allow vacuum suction to pass from tool body assembly 102 through pivot joint 106 and into bit housing 104.

Pivot tube 360 also includes a pair of slotted light source cable port openings 388, 390 on rear circumferential surface 378. These slotted port openings are disposed on either side of, and slightly below, central drive joint opening 366. A corresponding second pair of slotted light source cable port openings 392, 394 are present on front circumferential surface 372 and are disposed in-line with slotted port openings 388, 390 respectively.

It should be noted that slotted light source cable port openings 388 and 392 are disposed on pivot tube 360 such that they are in-line and in open alignment with light source cable port 208 in tool body 126 and light source cable port 334 in bit housing 260. Similarly, slotted light source cable port openings 390 and 394 are disposed on pivot tube 360 such that they are in-line and in open alignment with light source cable port 210 in tool body 126 and light source cable port 336 in bit housing 260. Thus, each of the slotted light source cable port openings is disposed to allow split light source cables 246 and 248 to pass from tool body assembly 102 through pivot joint 106 and into bit housing 104.

Pivot tube 360 also includes a pair of alignment recesses 432 disposed around the entire outer radial surface of pivot tube 360. These alignment ridges are provided to receive complimentary alignment ridges 429 and 431 on tool body 126 and bit housing 260 respectively thereby aiding in the proper alignment of pivot tube 360 with tool body 126 and bit housing 260.

Each pivot tube nut 362, 364 is circular in shape and is inserted in an opening in the ends of pivot tube 360. A grease zerk 402 is provided on the outside surface of each pivot tube nut to allow for lubrication of pivot joint 106. A vacuum channel 404 is cut through the top radial or circumferential edge surface of each nut. In a similar manner, a light source channel 406 is cut through the bottom radial or circumferential edge surface of each nut. Channels 404, 406 are oriented perpendicular to pivot axis 400.

Each vacuum channel 404 is disposed to be in-line and in open alignment with a corresponding pair of slotted vacuum port openings in pivot tube 360 when pivot tube nuts 362, 364 are installed in pivot tube 360. Thus, it can be seen that a pair of vacuum passageways are provided on either side of pivot joint 106 to allow for vacuum suction to pass through pivot joint 106 from tool body assembly 102 and into bit housing assembly 104.

In a similar manner, each light source cable channel 406 is disposed to be in-line and in open alignment with a corresponding pair of slotted light source cable port openings in pivot tube 360 when pivot tube nuts 362, 364 are installed in pivot tube 360. Thus, a pair of light source cable passageways are also provided through pivot joint 106 to allow for the passage of internal light source cables 246, 248 through pivot joint 106 from tool body assembly 102 and into bit housing assembly 104.

In addition to channels 404 and 406, the front radial or circumferential edge surface (the outer radial surface closest to bit housing 260) of each pivot tube nut 362, 364 includes a oblong slot 408 drilled partially into the outer radial or circumferential edge surface of the nut. Oblong slots 408 are provided for the following purpose. As previously discussed, mounting screws 278 are provided to attach pivot tube 360 to bit housing 260. The threaded end of each mounting screw 278 is threaded into fastener receiving holes 368 to make this attachment. To insure for complete thread engagement, however, it is desirable to have the threaded ends of each mounting screw 278 protrude through holes 368 and into the center of pivot tube 360. Oblong slots 408 are included to provide clearance between the threaded end of each mounting screw 278 and each pivot tube nut 362 or 364.

The rear radial or circumferential edge surface (the radial edge surface closest to tool body 126) of each pivot tube nut 362, 364 includes a drilled and tapped threaded fastener receiving hole 410. These holes, which are disposed on each pivot tube nut to be in-line and in open alignment with holes 252 in tool body 126, are provided for receiving the threaded pivot ends of draw rods 256. The threaded draw rod ends pass through slotted draw rod openings 374 in the rear circumferential surface of pivot tube 360 and into threaded holes 410 to slidably attach pivot tube 360 to tool body assembly 102.

Assembly of equine dental tool 100 will how be described. Initial assembly begins by partially assembling bit housing assembly 104. First bearing subassembly 282 is slid on to collet shaft 286. Drive socket 280 is then attached to the pivot end of collet shaft 286 and is secured in place using either a set screw or a spring pin that passes through collet shaft 286. In one embodiment, bearing subassembly 282 is held in place on collet shaft 286 by shoulder 356 and drive socket 280. In an alternative embodiment, a bearing retaining collar 284 is used to secure bearing assembly 282 in place next to drive socket 280.

At this point, bit drive shaft subassembly 266 is inserted into bit drive shaft opening 300 from rear curved pivot end surface 274 of bit housing 260 until the forward end of bearing subassembly 282 abuts up against shoulder 306. In this installed position, drive socket 280 extends out of the coped pivot end 270 of bit housing 260.

With bit drive shaft subassembly 266 installed into bit drive shaft opening 300, the next step is to attach pivot joint 106 to coped end 270 of bit housing 260. This is accomplished by sliding central drive opening 366 of pivot tube 360 over drive socket 280 such that front circumferential surface 372 (the surface closest to bit housing 260) of pivot tube 360 is disposed adjacent to curved pivot end surface 274 of bit housing 260. At this point, each threaded hole 368 on the front circumferential surface 372 of pivot tube 360 should be in alignment with a respective mounting screw hole 276 in bit housing 260 and the pair of alignment ridges 431 disposed on concave curved surface 274 should be in alignment with complimentary alignment recesses 432 disposed around the outer circumference of pivot tube 360.

The two mounting screws 278 are then inserted into holes 276 of bit housing 260 and are partially threaded into threaded holes 368 on the front circumferential surface of pivot tube 360. It should be noted that each screw 278 is only partially threaded into its respective threaded hole 368 at this time such that the ends of the screws do not penetrate into the interior of pivot tube 360.

A pivot tube nut is now inserted into each open end of pivot tube 360 with the slotted clearance recess 408 on the edge of the pivot tube nut adjacent to threaded hole 368 on pivot tube 360. Each mounting screw 278 is now further threaded into holes 368 such that the threaded ends of each screw 278 protrudes completely through the front circumferential wall 372 of pivot tube 360 and into the slotted clearance openings 408 in the edge of each pivot nut. This insures that there will be complete thread engagement between the threads on screws 278 and the threads of threaded holes 368. In this manner, pivot joint 106 is fixedly attached to coped end 270 of bit housing 260 and drive socket 280 extends through central drive opening 366 and into the interior of pivot tube 360.

We now turn to drive shaft assembly 128. Drive ball 172 is first installed on to the pivot end of drive shaft 160. A set screw or spring pin is used to hold drive ball 172 in place. Next, bearing subassembly 170 and bearing retaining collar 168 are slid onto drive shaft 160 and positioned next to drive ball 172. Retaining collar 168 is positioned on drive shaft 160 with its raised face 422 adjacent to bearing 168 to hold bearing subassembly 170 in place next to drive ball 172. The purpose for raised face 422 is to engage the inner race of the adjacent bearing 168 thereby creating clearance for the non-rotating seal and outer race of the bearing. A set screw is used to hold bearing retaining collar 168 at the desired location on drive shaft 160.

We now turn our attention to tool body assembly 102. We begin by inserting vacuum seal tube 224 into recess 222 on the front mating surface 132 of accessory mounting block 122. At this time, we can also thread vacuum hose adaptor 218 into threaded input hole 214 of accessory mounting block 122.

Next, we begin installing light source cable 242 into tool body assembly 102. This is accomplished by first placing accessory mounting block 122, handle mounting block 124 and tool body 126 in their respective aligned positions next to each other on a flat surface. These three components should be placed on the flat surface such that the top surface 148 of tool body 126 is facing downward and thus the two light source cable ports 208, 210 in tool body. 126 are away from the flat surface.

The end of one of the split light source cables 246, 248 is first inserted through light source cable port 206 of accessory mounting block 122 from the accessory mounting side of accessory mounting block 122 such that it protrudes out of the other end by about an inch or so. The end of the other split light source cable is then inserted through light source cable port 206 of accessory mounting block 122 in a similar manner.

At this point, the ends of each split cable 246, 248 protrude out of the front side of accessory mounting block 122 by about an inch or so. Split cables 246, 248 are now pulled together through light source cable port 206 until adaptor 250 on the non-split end of light source cable 242 abuts up against shoulder 234 of light source cable port 206.

Adaptor retaining collar 120 can now be threaded into threaded input port 230 to hold adaptor 250 in place. It should be noted that it is desirable to hold non-split cable 244 which protrudes out of the front side of accessory mounting block 122 while threading retaining collar 120 into threaded hole 230. The reason for this is to insure that internal light source cable 242 is not twisted during installation of retaining collar 120.

At this point, the ends of each split light source cable 246, 248 are inserted completely through light source cable port 206 of handle mounting block 124 and into a respective one of the two light source cable ports 208, 210 in tool body 126. Talcum powder can be applied to the outer sheath of each split cable 246, 248 to provide for easier insertion of the cables through tool body 126. It should be noted that the inside wall surfaces of light source cable ports 208, 210 should be clean and dry before insertion of cables 246, 248 begins. If the inside surfaces of these ports are not clean and dry, the talcum powder may stick to the inside hole surfaces making insertion more difficult.

As an alternative to using talcum powder, the outer sheath of each split cable 246, 248 can be coated with a graphite coating to provide for easier insertion of the cables through tool body 126.

Eventually, the end of each split light source cable 246, 248 will emerge from coped pivot end 156 of tool body 126. At this point, accessory mounting block 122 is positioned adjacent to, but spaced apart from, handle mounting block 124, handle mounting block 124 is positioned adjacent to, but spaced apart from, tool body 126, and internal light source cable 242 has been inserted through each of these three components. The drive end of partially assembled drive shaft assembly 128 is now inserted into drive shaft opening 184 from coped pivot end 156 of tool body 126 and is pushed through the drive shaft opening in handle mounting block 124 and accessory mounting block 122, each of which should still be lying in alignment with tool body 126 on the flat surface.

Drive shaft assembly 128 is not pushed all the way into tool body 126 at this time however. Rather, it is inserted to the point where drive ball 172 extends out of coped pivot end 156 by about an inch or so. The reason for doing this is to provide access to drive ball 172 so that it can be mated with drive socket 280. It should also be noted that even in this position, the drive end of drive shaft 160 (with nothing assembled onto it) extends out of accessory mounting block 122 and is also accessible.

With internal light source cable 242 installed in partially assembled tool body assembly 102, and with partially assembled drive shaft assembly 128 inserted into drive shaft opening 184, the next step is to insert the two draw rods 256 into draw rod holes 252 from coped pivot end 156 of tool body 126. Each draw rod is inserted such that its slotted end (the end configured to receive the blade of a screwdriver) will be disposed at the drive end of tool body assembly 102 adjacent accessory mounting block 122.

Next, the pivot joint end of bit drive shaft assembly 266, which is now disposed inside of pivot tube 360, is mated with the pivot joint end of drive shaft subassembly 128. To accomplish this, the coped pivot end of partially assembled tool body assembly 102 is placed in close proximity to the pivot end of partially assembled bit housing assembly 104 such that the two assemblies are in longitudinal alignment with each other.

With these two assemblies in close proximity to each other, drive pin 174 is inserted into drive ball 172 and drive ball 172 is moved toward drive socket 280. This is accomplished by holding onto the drive end of drive shaft 160 and slowly pushing it into accessory mounting block 122. At the same time that it is being slowly pushed forward, drive shaft 160 is also rotated slightly. Rotation of drive shaft 160 results in rotation of drive pin 174 and in this way, drive pin 174 can be rotated into alignment with a pair of drive pin receiving slots 350 disposed on drive socket 280. Drive shaft 160 is rotated until the flat end surfaces 352 of drive pin 174 are received in drive pin receiving slots 350 of drive socket 280. At this point, drive ball 172 is pushed inside of drive socket 280 to complete the connection between drive shaft assembly 128 and bit drive shaft assembly 266.

It should be noted that at this point, a single main drive shaft assembly has been assembled that runs the entire length of dental tool 100. The first section of the main drive shaft assembly is comprised of drive shaft subassembly 128 that rotates or spins about longitudinal axis 186 of tool body assembly 102. The second section of the main drive shaft assembly is comprised of bit drive shaft subassembly 266. This section rotates or spins about, longitudinal axis 298 of bit housing assembly 104. The two drive shaft sections are coupled together via the ball and socket joint that is formed between drive ball 172 and drive socket 280. This ball and socket joint is located inside of pivot joint 106. The ball and socket joint combined with the other structures that make up pivot joint 106 allow the second drive shaft section (and bit housing assembly 104) to pivot relative to the first drive shaft section (and relative to tool body assembly 102).

It should also be noted that the present invention is not limited to the use of a ball and socket joint to connect or couple the two drive shaft sections together and in other embodiments of the present invention, other types of coupling mechanisms are used. For example, a universal joint can be used in an alternative embodiment.

With the drive joint assembled, the next step is to attach pivot joint 106 to coped pivot end 156 of tool body 126. This is accomplished by slowly sliding partially assembled tool body assembly 102 forward such that the mated drive ball joint slides into central drive opening 366 of pivot tube 360 and the pair of alignment ridges 429 disposed on concave curved surface 140 should be in alignment with complimentary alignment recesses 432 disposed around the outer circumference of pivot tube 360.

As coped end 156 of tool body 126 approaches pivot tube 360, the ends of each split light source cable 246, 248, which are protruding from coped end 156, slide through slotted openings 388, 390 in rear circumferential surface 378 of pivot tube 360, through slotted channels 406 in pivot tube nuts 362, 364, through slotted openings 392, 394 in front circumferential surface 372 of pivot tube 360, and into their respective light source cable ports 334, 336 in bit housing 260. At this point, the ends of each split light source cable should be disposed in close proximity to their final position inside of bit housing assembly 104.

At this point, the threaded pivot end of each draw rod 256 should be disposed in or near one of the slotted draw rod openings 374 in rear circumferential face 378 of pivot tube 360 and in close proximity to a respective threaded hole 410 in pivot tube nuts 362, 364. At the same time, the other end of each threaded rod should be in close proximity to the threaded section of its respective draw rod hole located in accessory mounting block 122.

The front end of partially assembled dental tool 100 should now be placed up against a fixed surface to prevent it from sliding forward. The various components of dental tool 100 should then be pushed together such that the ends of each draw rod 256 are inserted into their respective threaded holes 410 in pivot tube nuts 362, 364 and threaded holes 254 in accessory mounting block 122.

A slotted screwdriver is inserted into a first one of the draw rod access holes 258 disposed on rear accessory mounting surface 130 of accessory mounting block 122. The first of the two draw rods is turned counterclockwise approximately one-half turn, just enough to engage the threads on each end of the draw rod with threaded holes 410 in pivot tube nuts 362, 364 and threaded holes 254 in accessory mounting block 122. The screwdriver is then moved to the other draw rod access hole and the other draw rod is turned counterclockwise approximately one-half turn to accomplish the same thing.

Each draw rod 256 is then alternately turned using the screwdriver inserted into the access holes that are provided on the rear face 130 of accessory mounting block 122. As each draw rod is turned a half turn, first one, then the other, the ends of each draw rod are slowly threaded into threaded holes 410 in pivot tube nuts 362, 364 and into threaded holes 254 on the flat front mating surface 132 of accessory mounting block 122. This in essence pulls or draws all of the parts together. The draw rods are alternately turned until the entire assembly is drawn together. At this point, accessory mounting block 122 should be tight up against handle mounting block 124, handle mounting block 124 should be tight up against tool body 126, and the rear circumferential surface 378 of pivot tube 360 should be in slidable engagement with curved pivot surface 140 of tool body 126. It should also be noted that as accessory mounting block 122 is drawn toward handle mounting block 124, vacuum seal tube 222 is drawn into round hole 226 on handle mounting block 124.

The next step is to assemble the drive end of drive shaft assembly 128. This is accomplished by first sliding bearing retaining collar 166 and the two ball bearings 164 onto the drive end of drive shaft 160. Drive cable adaptor 162 is then attached to the drive end of drive shaft 160 using a pair of set screws or a spring pin that passes through drive shaft 160. With drive cable adaptor 162 attached to drive shaft 160, bearing retaining collar 166 is positioned on drive shaft 160 with its raised face 420 away from tool body 126 to retain the two side-by-side ball bearings 164 next to drive cable adaptor 162. The purpose for raised face 420 is to engage the inner race of the adjacent bearing 164 thereby creating clearance for the non-rotating seal and outer race of the bearing. Bearing retaining collar 166 is secured in place on drive shaft 160 using a small set screw or spring pin.

At this point, bit 262 can now be installed in bit housing 260. First, a keyed wrench having a square shaft is inserted into square receptacle 354 in the end of drive cable adaptor 162 thereby preventing rotation of drive shaft 160 and collet shaft 286 (which is now connected to drive shaft 160). Next, collet nut 288 is slid onto bit shaft 290 and bit shaft 290 is inserted into the bit end of collet shaft 286. Collet nut 288 is then threaded onto collet shaft 286 until bit shaft 290 is locked in place on the end of collet shaft 286.

Fiber optic light port lenses 344 are now inserted into the open ends 340, 342 of light source cable ports 334, 336 respectively. Lenses 344 are secured in place in open ends 340, 342 using a small bead of clear silicone sealant that is applied around the circumference of each lens prior to insertion into open ends 340, 342.

At this point, bit guard 264 can be installed onto bit housing 260 using screws 310.

The final steps in assembling dental tool 100 involve installation of angle locking handle 110 and pistol grip handle 108. Angle locking handle 110 is inserted into drive shaft opening 185 from the rear end of accessory mounting block 122 and is then threaded into threaded section 194 until it abuts lightly up against the locking shoulder portion 192 of flat mating surface 134 of handle mounting block 124. Finally, pistol grip handle 108 is installed onto one of handle mounting flanges 142, 144 and locking knob 118 is rotated to lock pistol grip handle 108 in place.

At this point, accessory mounting block 122, handle mounting block 124 and tool body 126 are fixedly attached to each other. Bit housing assembly 104, however, is capable of pivoting relative to tool body assembly 102 about pivot axis 400. This is because bit housing 104 is not fixedly attached to tool body assembly 102. Rather, bit housing assembly 104 is allowed to pivot upwards and downwards relative to longitudinal axis 186 and thus relative to tool body assembly 102. This occurs because pivot tube nuts 362, 364, to which tool body assembly 102 is fixedly attached, freely rotate inside of pivot tube 360 to which bit housing assembly 104 is attached. Since bit housing 104 is fixedly attached to pivot tube 360 and tool body assembly 102 is fixedly attached to pivot tube nuts 362, 364, and since pivot tube nuts 362, 364 freely rotate inside of pivot tube 360, bit housing assembly 104 can pivot relative to tool body assembly 102.

Figure 16:
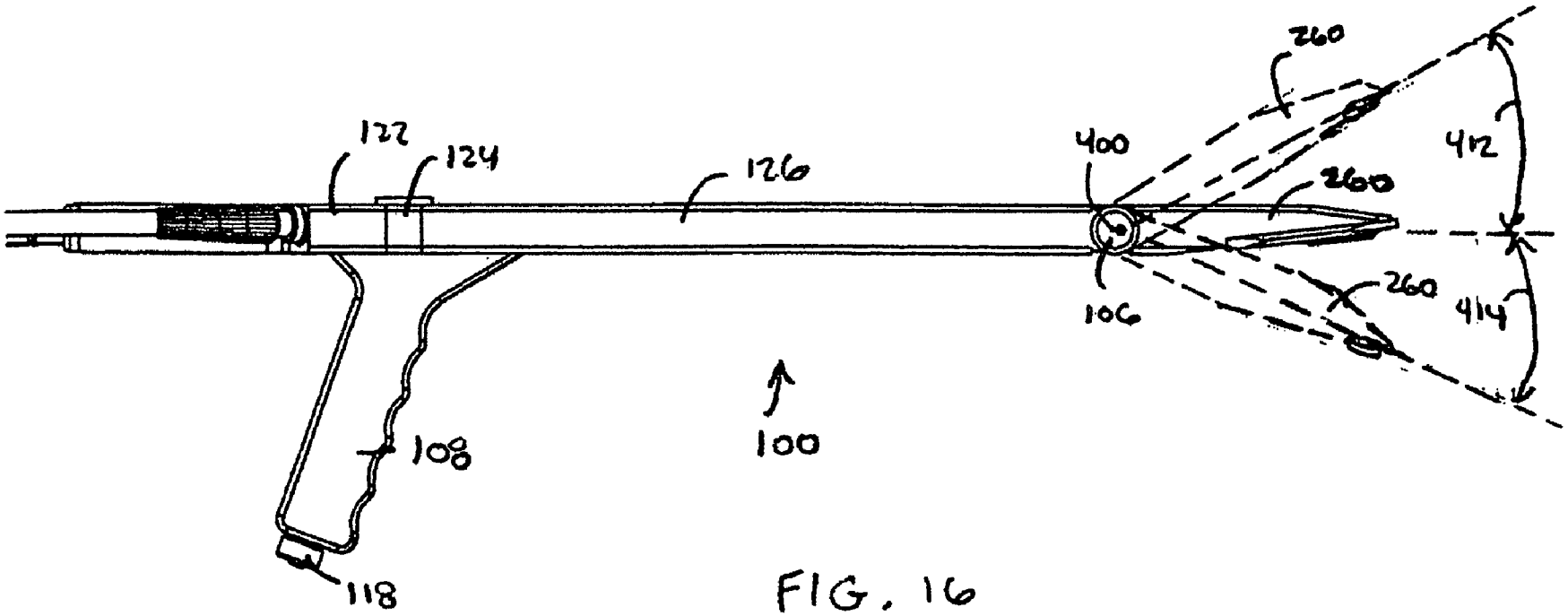
FIG. 16 is a side plan view of the dental tool of FIG. 1.

In one embodiment, the range of motion is 14 degrees, seven (7) degrees upward (see angle 412 in FIG. 16) and seven (7) degrees downward (see angle 414 in FIG. 16). In another embodiment, bit housing assembly 104 pivots as much as two and one-half (2.5) degrees upwards (angle 412) and eleven and one half (11.5) degrees downward (angle 414). The limits on the range of motion is determined by the length of the various slotted openings that are provided in pivot tube 360 for receiving draw rods 256 and light source cables 246, 248. The longer the slots, the greater the range of motion. Of course, as pivot tube 360 is made larger in diameter, the length of these slots can be increased. However, increasing the size of pivot tube 360 also inevitably will increase the size and weight of the dental tool. Thus, a trade off must be maintained between range of bit motion and the size and weight of the dental tool.

To adjust pivot angles 412, 414 (see FIG. 16) of bit housing 104 relative to tool body assembly 102 (and relative to longitudinal axis 186), bit housing 104 is simply pivoted about pivot axis 400. Once the desired angle is reached within the range of pivot angles, angle locking handle 110 is threaded further into drive end section 185 of drive shaft opening 184 until the forward end of angle locking handle 110 abuts tight up against locking shoulder 192 (which is part of rear mating surface 134 of handle mounting block 124).

Continuing to turn angle locking handle 110 at this point will cause accessory mounting block 122 to separate from handle mounting block 124 and will cause pivot joint 106 to be forced tight up against the coped end of tool body 126. This is because accessory mounting block 122 is attached to pivot joint 106 via draw rods 256. Thus as accessory mounting block 122 moves backward, so does pivot joint 106. More specifically, the rear circumferential surface 378 of pivot tube 360 is forced tight up against curved pivot end surface 140 of tool body 126 such that it is no longer in slidable engagement with curved pivot end surface 140. In this way, bit housing 104 can be frictionally locked at a desired angle relative to tool body 126.

It should be noted that vacuum seal tube 224 is provided between accessory mounting block 122 and handle mounting block 124 to insure that the integrity of vacuum port 200 is maintained when angle locking handle 110 is used to lock bit housing 104 at a desired angle.

Figure 17:
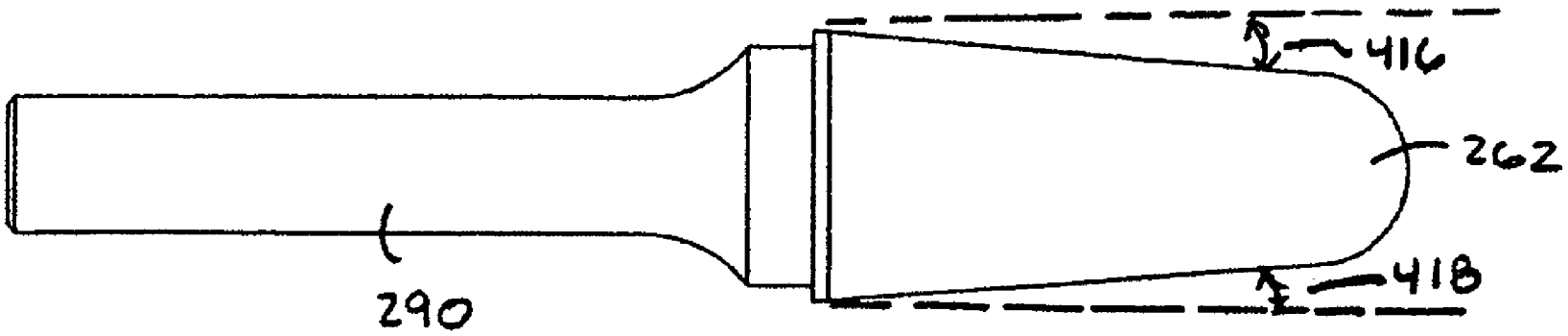
FIG. 17 is a plan view of a grinding member used in the dental tool of FIG. 1.

It should also be noted that grinding bit 262 in one embodiment is a tapered bit or bur having an included angle of fourteen (14) degrees. In other words, angle 416 in FIG. 17 is seven (7) degrees and angle 418 is seven (7) degrees. Using this bit in a dental tool having a range of bit housing angles of seven (7) degrees upward (angle 412) and seven (7) degrees downward (angle 414) will result in a net angle on the grinding surface of bit 262 of fourteen (14) degrees upward and zero (0) degrees downward when dental tool 100 is held in a horizontal position.

If, on the other hand, a bit having an included angle of nine (9) degrees is used (e.g., angle 416 is 4.5 degrees and angle 418 is 4.5 degrees) in a dental tool having a range of bit housing angles of two and one-half (2.5) degrees upward (angle 412) and eleven and one-half (11.5) degrees downward (angle 414), a net angle on the bit grinding surface of seven (7) degrees upward and seven (7) degrees downward will result when dental tool 100 is held in a horizontal position. Thus, when a tapered bit is used, the net upward and downward angle of the bit grinding surface can be equalized by choosing an appropriate range of bit pivot angles and an appropriate tapered bit inclusion angle.

It should also be noted that the present invention is not limited to the use of a tapered bit grinding member or a grinding member having the angles described above. Other embodiments of the present invention use non-tapered bits or tapered bits having different included angles than those mentioned herein. The present invention is also not limited to the use of steel shanked carbide bits (or burs) and in other embodiments of the present invention, grinding members made of other materials are used instead.

Shown in FIGS. 18-25 is a grinding member housing assembly 600 that can be used in place of bit housing assembly 104 in accordance with another embodiment of the present invention. Grinding member housing assembly 600 includes a cutting disc or wheel 606 instead of a grinding bit and therefore will be referred to herein as disc housing assembly 600 (also called disc head 600) to distinguish it from bit housing assembly 104. It should be noted that disc housing assembly 600 is interchangeable with bit housing assembly 104 such that either assembly can be used with dental tool 100.

At the outset, it should also be noted that unlike bit 262 which rotates about longitudinal axis 298 of bit housing assembly 104 (bit drive shaft assembly 266 also rotates about longitudinal axis 298), cutting disc 606 rotates about an axis that is at an angle to the longitudinal axis of disc housing assembly 600. This is accomplished by using two separate drive shaft subassemblies inside of disc housing assembly 600. The first of these drive shaft subassemblies is disposed along the longitudinal axis of disc housing assembly 600. The second of these drive shafts is coupled to the first drive shaft at an angle (referred to herein as the shaft angle). The shaft angle in the embodiment of the present invention shown in FIGS. 18-25 is ninety-four and one half (94.5) degrees. It should be understood, however, that the present invention is not limited to a shaft angle of ninety-four and one-half (94.5) degrees and in other embodiments of the present invention, other shaft angles are used.

Disc head 600 includes a disc housing 602, a cover plate 604, a cutting disc or cutting wheel 606, a sealing washer 608, a bearing nut 610, a bevel gear drive shaft subassembly 612 (see FIG. 18), and a pinion gear drive shaft subassembly 614. Rotational motion is transferred to cutting disc 606 through the engagement of pinion gear drive shaft subassembly 614 with bevel gear drive shaft subassembly 612 as will be more fully described below.

Bevel gear drive shaft subassembly 612 (see FIGS. 20-22) includes a shaft 660, a first sealed ball bearing 662, a second sealed ball bearing 664, a separate bearing retainer 666, a bearing retainer screw 668, and a bevel gear 670. Shaft 660 includes an upper smooth spindle portion 672, a bearing clearance shoulder 676, a bevel gear stop shoulder 675, a threaded lower shaft portion 674, and a sealing surface 677.

Clearance shoulder 676 provides clearance for the outer race and seal of bearing 664 when bearing 664 is mounted onto spindle 672. Threaded shaft portion 674 is provided to allow bevel gear 670 to be mounted onto shaft 660. Shoulder 675 provides a stop for bevel gear 670 when it is threaded onto threaded portion 674. Sealing surface 677, in combination with sealing washer 608, provides a seal for the chamber in which bevel gear 670 resides. The seal keeps foreign material out of the chamber and keeps lubricating grease inside of the chamber.

A first threaded hole 678 is disposed inside of upper spindle 672 and a second threaded hole 680 (see FIG. 22) is disposed inside of lower shaft 674. Four small keying holes 682 are disposed on the lower end of shaft 660. Keying holes 682 are provided to receive a four (4) prong spanner wrench (not shown). The spanner wrench is used to restrain shaft 674 while retainer screw 668 is threaded into hole 678 and is also used to restrain bevel gear drive shaft subassembly 612 during the installation of bevel gear 670 onto shaft 660.

Sealed ball bearings 662, 664 are disposed about smooth upper spindle 672. The inner race of lower bearing 664 is positioned adjacent to bearing clearance shoulder 676. Likewise, the inner race of upper bearing 662 is positioned adjacent to bearing retainer 666 when bearing retainer 666 is installed. Bearing retainer 666 is held in place using bearing retainer screw 668 which is threaded into hole 678. As previously mentioned, a four prong spanner wrench is inserted into holes 682 to restrain shaft 660 while retainer screw 668 is threaded into hole 678. The two bearings 662, 664 are thereby held in place on upper spindle 672 through the contact of their inner races with bearing retainer 666 and clearance shoulder 676 respectively.

Bevel gear 670 includes a threaded central opening or bore 684. The inner threads of central opening 684 are disposed to mate with the outer threads on threaded portion 674 of shaft 660. Shoulder 675 provides a stop surface for bevel gear 670 when it is installed onto shaft 660. In this embodiment, the threads on lower shaft portion 674 and on inner bore 684 are left-hand threads which are used to prevent bevel gear 670 from spinning off of shaft 660 during cutting operations.

A raised ridge 686 and four small keying holes 688 (see FIG. 22) are provided around opening 684 on the bottom side of bevel gear 670. Raised ridge 686 is provided to reduce the amount of friction that occurs between bevel gear 670 and seal 608 (which is mounted inside of disc housing assembly 600 directly below bevel gear 670) as bevel gear 670 rotates during cutting operations. Keying holes 688 are disposed to receive a second four (4) prong spanner wrench (not shown) used during the installation of bevel gear 670 onto shaft 660.

The top side of bevel gear 670 includes a plurality of gear teeth 690. These gear teeth are arranged around the outer perimeter of bevel gear 670 to mesh with the gear teeth on a pinion gear that is mounted on the end of pinion gear drive shaft subassembly 614.

Figure 18:
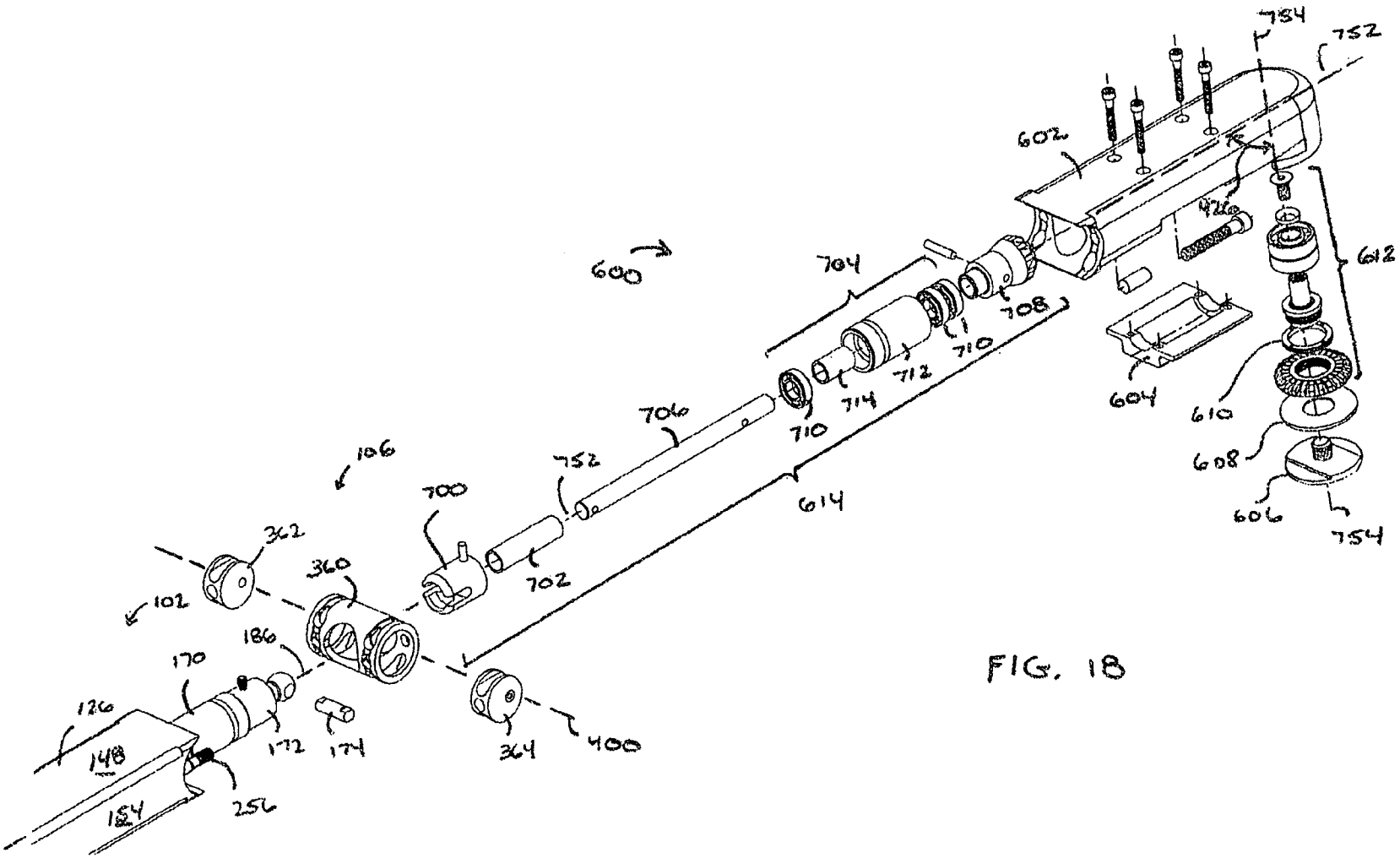
FIG. 18 is an exploded isometric top-side view of the grinding end of a power equine dental tool according to a second embodiment of the present invention as viewed from the drive end of the power equine dental tool.
Figure 19:
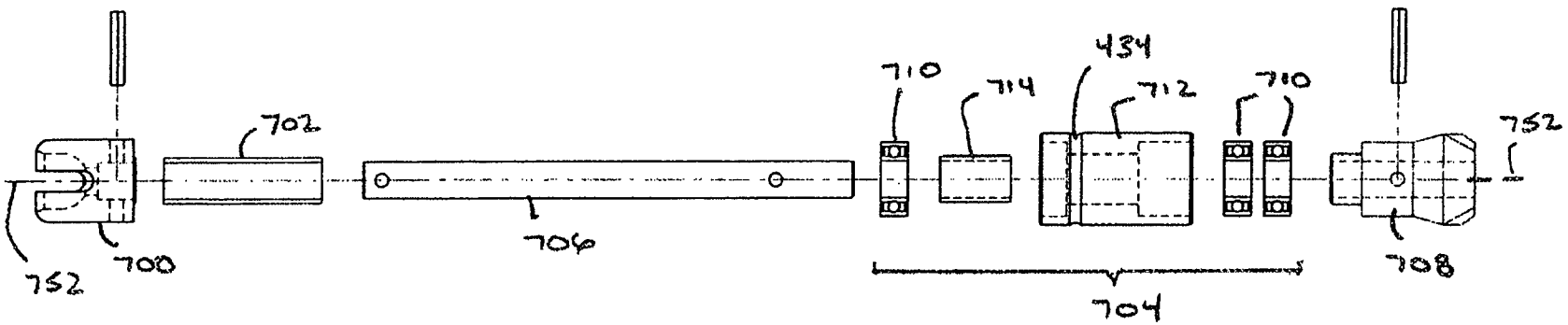
FIG. 19 is an exploded plan view of the pinion gear drive shaft subassembly of the power equine dental tool of FIG. 18.
Figure 20:
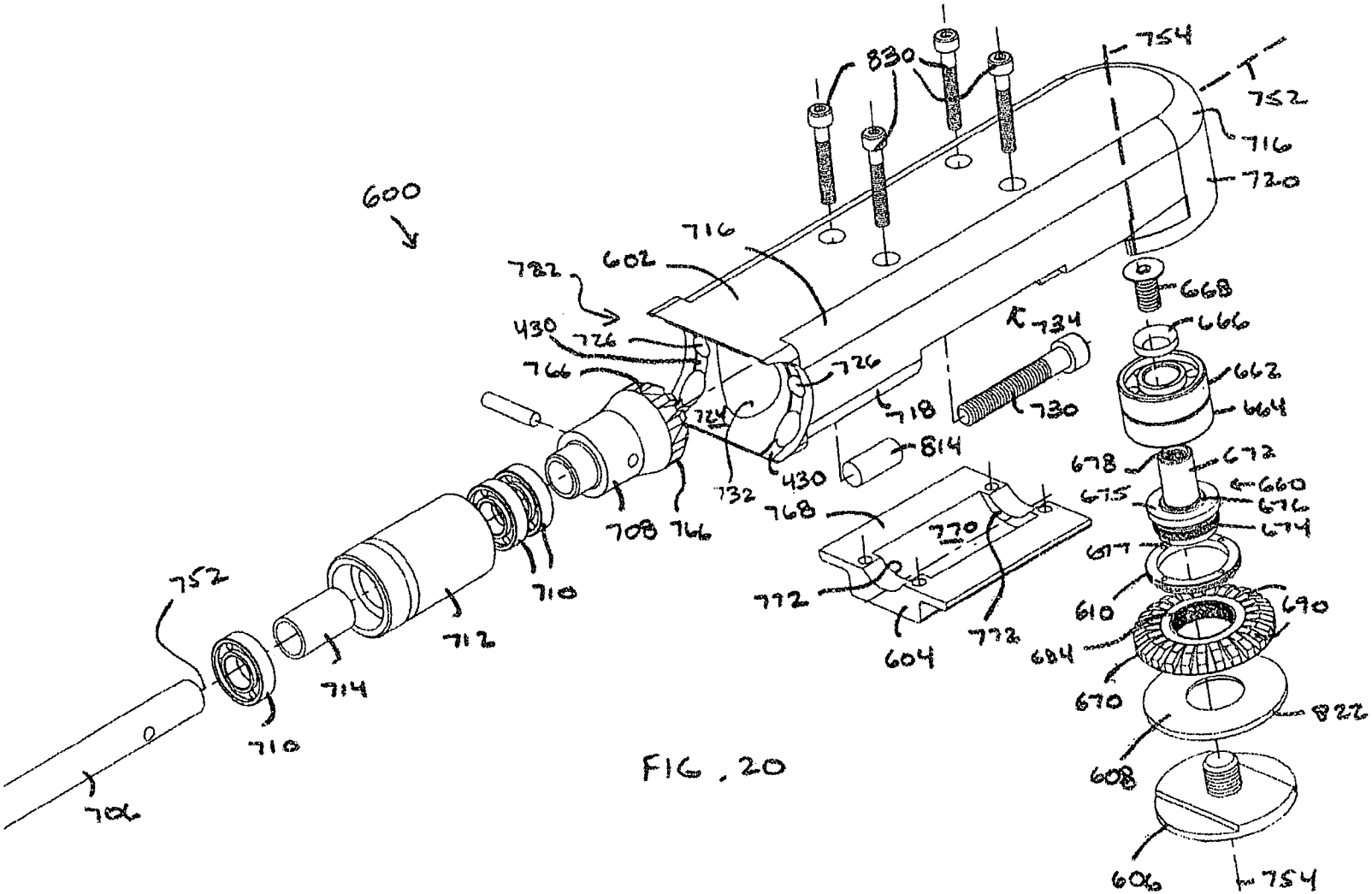
FIG. 20 is an exploded isometric close-up top-side view of the bit end of the power equine dental tool of FIG. 18 as viewed from the drive end of the power equine dental tool.
Figure 21:
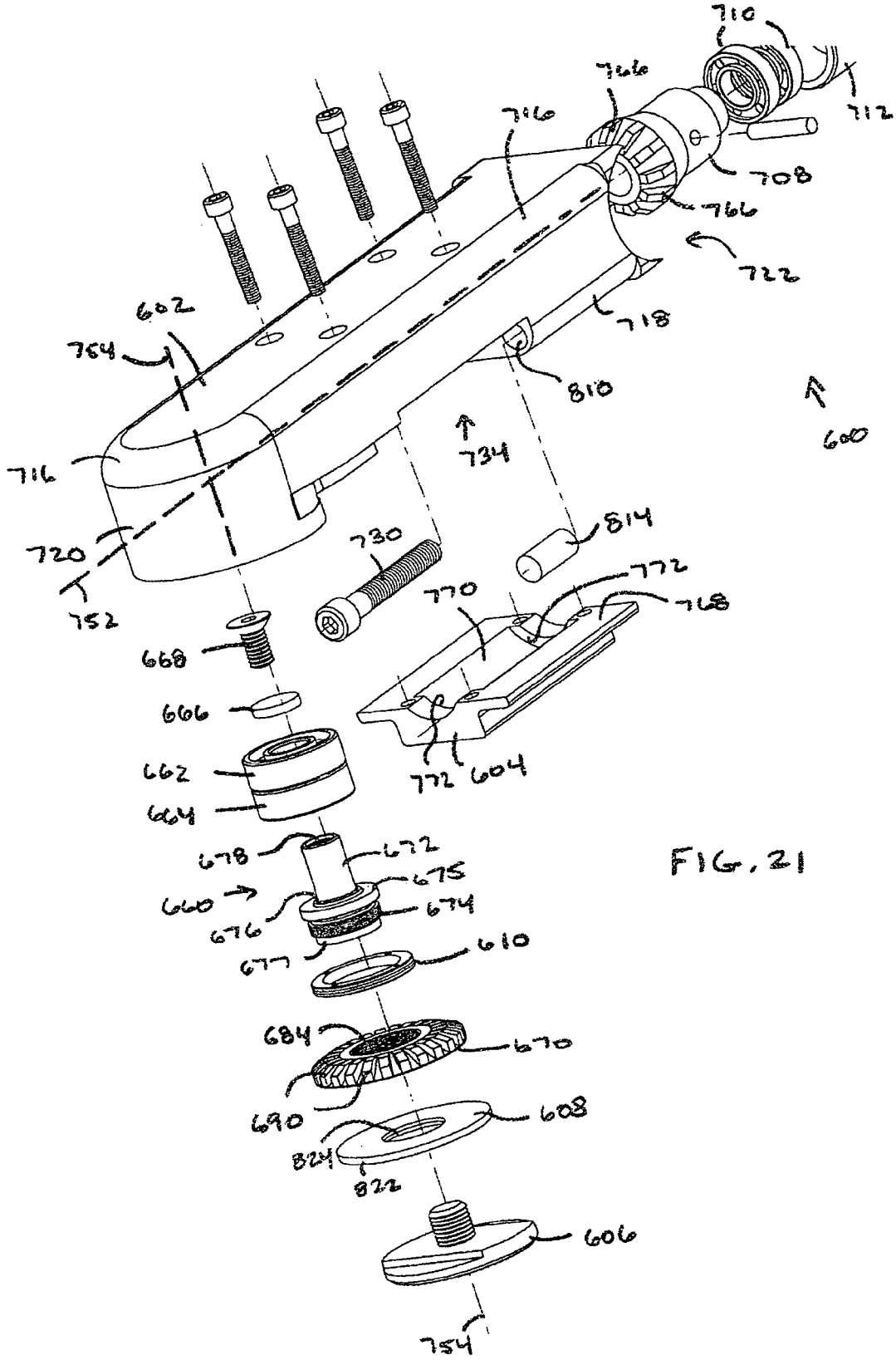
FIG. 21 is an exploded isometric close-up top-side view of the bit end of the power equine dental tool of FIG. 18 as viewed from the grinding end of the power equine dental tool.
Figure 22:
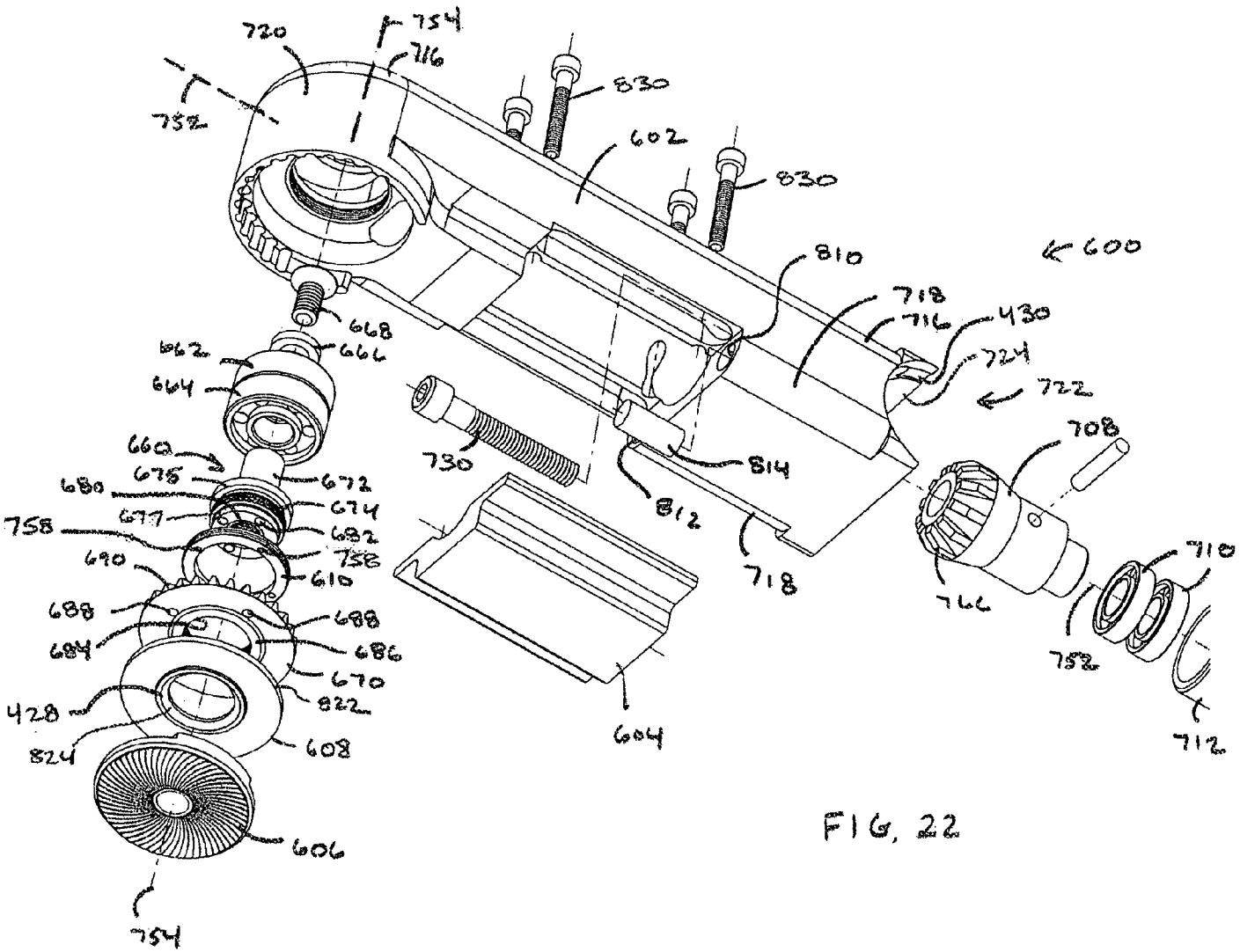
FIG. 22 is an exploded isometric close-up bottom-side view of the grinding end of the power equine dental tool of FIG. 18 as viewed from the grinding end of the power equine dental tool.

Pinion gear drive shaft subassembly 614 as best shown in FIGS. 18 and 19 includes a drive socket 700, a pinion shaft spacer 702, a bearing subassembly 704, a pinion shaft 706, and a pinion gear 708. Drive socket 700 is attached to the rear or pivot end of pinion shaft 706 using a spring pin or small set screw that engages with pinion shaft 706. Pinion gear 708 is attached to the other end (front end or cutting wheel end) of pinion shaft 706, also using a spring pin or small set screw that engages with pinion shaft 706.

Bearing subassembly 704 is disposed on pinion shaft 706 adjacent to pinion gear 708. Bearing subassembly 704 includes three sealed ball bearings 710 disposed inside of a bearing housing 712. Two of the bearings are disposed side-by-side in bearing housing 712 and are separated from the third bearing by a bearing spacer 714.

Bearing subassembly 704 is held in place on pinion shaft 706 by pinion gear 708 on one side and by pinion shaft spacer 702 on the other side. Pinion shaft spacer 702 is provided to insure that bearing subassembly 704 (which is used for alignment during assembly of disc housing assembly 600) is properly positioned on pinion shaft 706 between pinion gear 708 and drive socket 700.

Disc housing 602 includes a rounded front end 720 and a coped rear end or pivot end 722. Coped rear pivot end 722 of disc housing 602 includes a concave semi-circular curved surface 724 which allows disc housing assembly 600 to mate with pivot joint 106 in the same manner that bit housing 104 mates with pivot joint 106. In addition, the top edges 716 and bottom edges 718 of disc housing 602 are radiused to reduce the possibility of damage to the soft tissues in a horse's mouth during floating procedures.

A pair of longitudinally oriented mounting holes or passageways 726 are disposed on either side of disc housing 602 and are open at coped end 722. These mounting holes or passageways are disposed to receive a pair of mounting screws 730 that attach disc housing assembly 600 to pivot joint 106. A pair of alignment ridges 430 are disposed on concave curved surface 724 to aid in aligning disc housing 602 with pivot joint 106 during attachment. These ridges are received in complimentary recesses 432 that are disposed around the outer circumference of pivot tube 360.

Figure 23A:
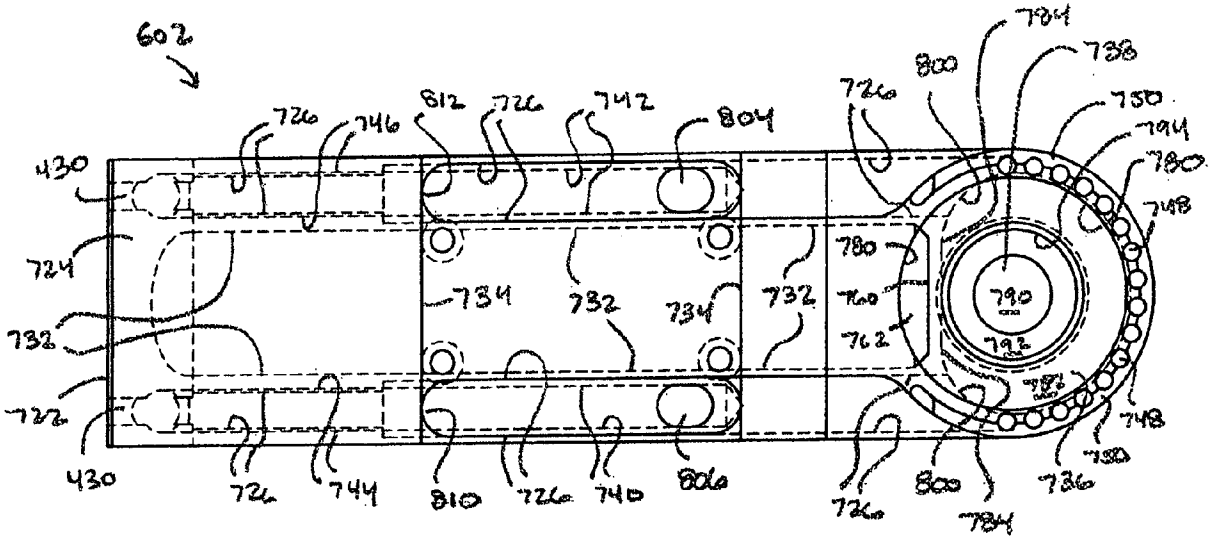
FIG. 23A is a bottom plan view of the disc housing of the power equine dental tool of FIG. 18 according to one embodiment of the present invention.
Figure 23B:
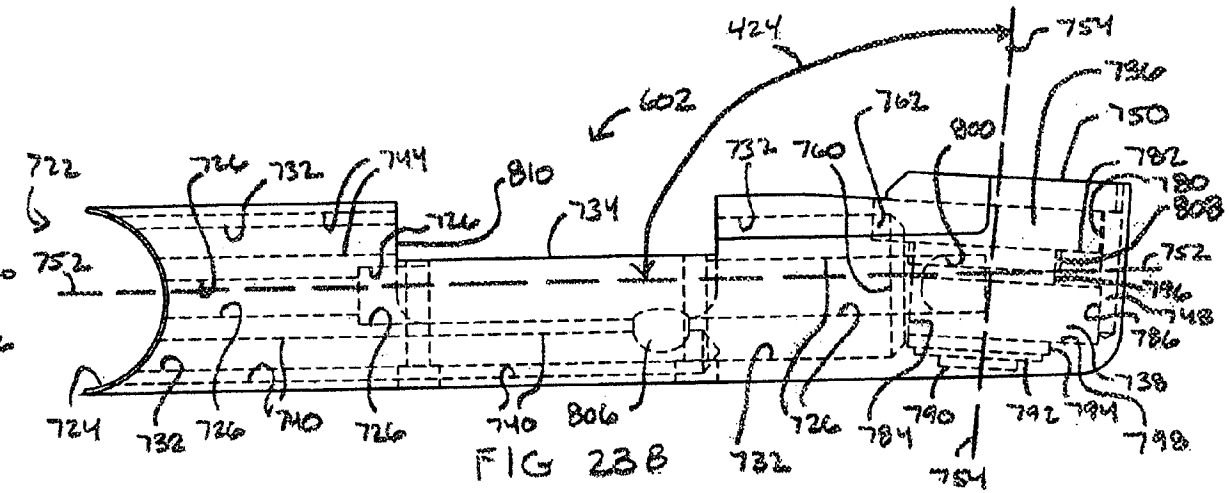
FIG. 23B is a side plan view of the disc housing of FIG. 23A.
Figure 23C:
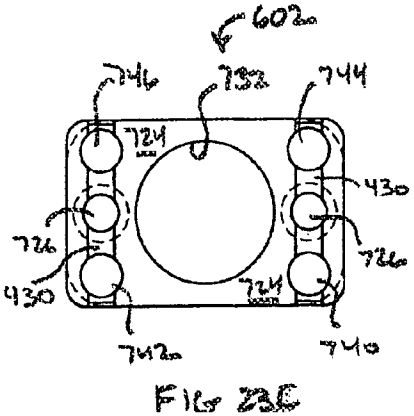
FIG. 23C is a rear end plan view of the disc housing of FIG. 23A.

In addition to mounting passageways 726, disc housing 602 also includes a pinion gear drive shaft opening or bore 732, a cover plate opening 734, a bevel gear chamber or cavity 736, a vacuum chamber or cavity 738, a pair of vacuum ports or passageways 740, 742, a pair of light source ports or passageways 744, 746, a plurality of vacuum holes or orifices 748 and a cutting disc guard 750 (see FIGS. 23A-C). Pinion gear drive shaft opening 732 is disposed inside of disc housing 602 along a longitudinal axis 752. Vacuum ports 740, 742 and light source ports 744, 746 run parallel to longitudinal axis 752 inside of disc housing 602.

Bevel gear cavity 736 is circular in shape and is disposed near the grinding end of disc housing 602. Cutting disc guard 750 is disposed on the outside of disc housing 602 below bevel gear cavity 736 to form a cutting disc cavity that shields cutting disc 606 during cutting operations. Vacuum chamber 738 is disposed inside of disc housing 602 directly above bevel gear cavity 736. Vacuum holes 748 are arranged on the outside of disc housing 602 around a portion of the outer perimeter of disc guard 750 and are disposed such that they are in vacuum communication with vacuum chamber 738. Each of these component parts will be described more fully below.

The rear or pivot end of pinion gear drive shaft bore 732 is open at coped end 722 to allow for insertion of pinion gear drive shaft subassembly 614. The other end, or front end, of pinion gear drive shaft bore 732 includes a flat front end wall 760 that separates pinion gear drive shaft opening 732 from vacuum chamber 738. A drive engagement opening 762 is provided between the front end of pinion gear drive shaft bore 732 and bevel gear cavity 736 to allow for meshed engagement of pinion gear 708 with bevel gear 670. Drive engagement opening 762 is disposed directly below front end wall 760.

In addition to drive engagement opening 762, another portion of pinion gear drive shaft bore 732 is exposed and open on the underside of disc housing 602 during assembly of disc housing assembly 600. This open portion, referred to herein as cover plate opening 734, is provided to allow for proper alignment of pinion gear drive shaft subassembly 614 within pinion gear drive shaft bore 732 as well be described more fully below.

As previously mentioned, pinion gear drive shaft opening 732 is configured to receive pinion gear drive shaft subassembly 614. More specifically, when pinion gear drive shaft subassembly 614 is properly installed inside of pinion gear drive shaft opening 732, pinion gear 708, which is attached to the front end of pinion shaft 706, is positioned adjacent to front end wall 760. In this position, the gear teeth 766 on pinion gear 708 are disposed through drive engagement opening 762 (for ready engagement with the gear teeth 690 on bevel gear 670), drive socket 700 extends outward from coped end 722 of disc housing 602 (for ready engagement with drive ball 172 which is disposed on the end of drive shaft assembly 128 of tool body assembly 102), and bearing subassembly 704 is positioned adjacent to cover plate opening 734.

Proper alignment and positioning of pinion gear drive shaft subassembly 614 inside of disc housing 602 is provided by cover plate 604. The underside 768 of cover plate 604 (e.g., the top side when cover plate 604 is mounted to disc housing 602) includes a curved clearance recess 770 and a pair of alignment ridges 772 disposed on either end of recess 770. Alignment ridges 772 are disposed at either end of recess 770 and engage with the front and rear end surfaces of bearing subassembly 704 when cover plate 604 is installed onto disc housing 602. This engagement insures proper positioning of pinion gear drive shaft subassembly 614 inside of disc housing assembly 600. Recess 770 is provided to allow for clearance between bearing subassembly 704 and cover plate 604 when cover plate 604 is fastened to disc housing 602.

Bevel gear cavity 736 is circular in shape and includes an outer radial or circumferential sealing wall 780 and a top wall 782. Drive engagement opening 762, which is cut out of sealing wall 780 and top wall 782, opens into bevel gear cavity 736 to allow for meshed engagement of pinion gear 708 with bevel gear 670. Bevel gear cavity 736 is oriented about an axis 754 that is at an angle 424 of ninety-four and one-half (94.5) degrees relative to longitudinal axis 752 (or, put another way, at an angle of four and one-half (4.5) degrees from a line perpendicular to longitudinal axis 752).

It should be noted that in the embodiment shown in FIGS. 18-25, the pitch angle of gear teeth 690 on bevel gear 670 and the pitch angle of gear teeth 766 on pinion gear 708 are designed to provide a shaft angle that is the same as the angle between the axis of bevel cavity 736 and the longitudinal axis of disc housing assembly 600. In other words, a shaft angle 426 (see FIG. 18) of ninety-four and one-half (94.5) degrees exists between the axis of rotation 754 of bevel gear drive shaft subassembly 612 and the axis of rotation 752 of pinion gear drive shaft subassembly 614.

It should also be understood that in other embodiments of the present invention, the shaft angle between the axis of rotation of pinion gear drive shaft subassembly 614 and the axis of rotation of bevel gear drive shaft subassembly 612 has a different value. For example, in alternative embodiments, this shaft angle is ninety (90) degrees, substantially ninety (90) degrees, or some other angle that is greater than zero (0) or greater than ninety (90) degrees.

Disposed below a portion of the circumference of bevel gear cavity 736, and extending downward, is cutting disc guard 750. Cutting disc guard 750 provides a cutting disc cavity that shields cutting disc 606 from the soft tissues of the horses mouth during cutting operations. An access opening 756 is provided in the rear section of cutting disc guard 750 to provide access to the keyed top side of cutting disc 606. A thin specially designed open end wrench (not shown) can be inserted through access opening 756 along the underside of disc housing 602 to engage with the keyed surface of cutting disc 606 thereby facilitating the removal and/or replacement of cutting disc 606 in this embodiment.

Vacuum chamber 738 is disposed directly above bevel gear cavity 736. With the exception of the rear radial or circumferential wall portion 784 of vacuum chamber 738, which is flat, the outer radial wall 786 of vacuum chamber 738 is circular in shape. The plurality of vacuum orifices 748 are arranged around the inner perimeter of cutting disc guard 750 in the vicinity of cutting disc 606. Each vacuum orifice 748 extends upward through disc housing 602 and is in open vacuum communication with vacuum chamber 738. Thus, enamel debris produced and expelled during the floating procedure can be vacuum suctioned through vacuum orifices 748 and into vacuum chamber 738.

In addition to providing vacuum suction in and around cutting disc 606, vacuum chamber 738 is also configured to house bevel gear drive shaft subassembly 612. To accomplish this, vacuum chamber 738 includes a bearing retainer screw clearance cavity 790, a bearing race relief cavity 792, and a pair of circular shaped bearing bores 794, 796, all of which are centered in vacuum chamber 738 about tilted axis 754.

Bearing retainer screw clearance cavity 790 and bearing race relief cavity 792 are concentrically disposed in the top wall 798 of vacuum chamber 738. Bearing retainer screw clearance cavity 790 is disposed to receive the head of bearing retainer screw 668 when bevel gear drive shaft subassembly 612 is mounted in disc housing 602. Similarly, bearing race relief cavity 792 is disposed in top wall 798 to provide clearance for the top edge of the inner race of upper bearing 662.

Bearing bore 794 is also disposed in top wall 798 of vacuum chamber 738 and is positioned to receive the outer race of upper bearing 662. Bearing bore 796 is disposed between vacuum chamber 738 and bevel gear cavity 736 and is positioned to receive the outer race of lower bearing 664. The diameter of each of bearing bores 794, 796 is such that when bevel gear subassembly 612 is inserted into disc housing 602, bearings 662, 664 are lightly press fit into bearing bores 794, 796 respectively.

Figure 24:
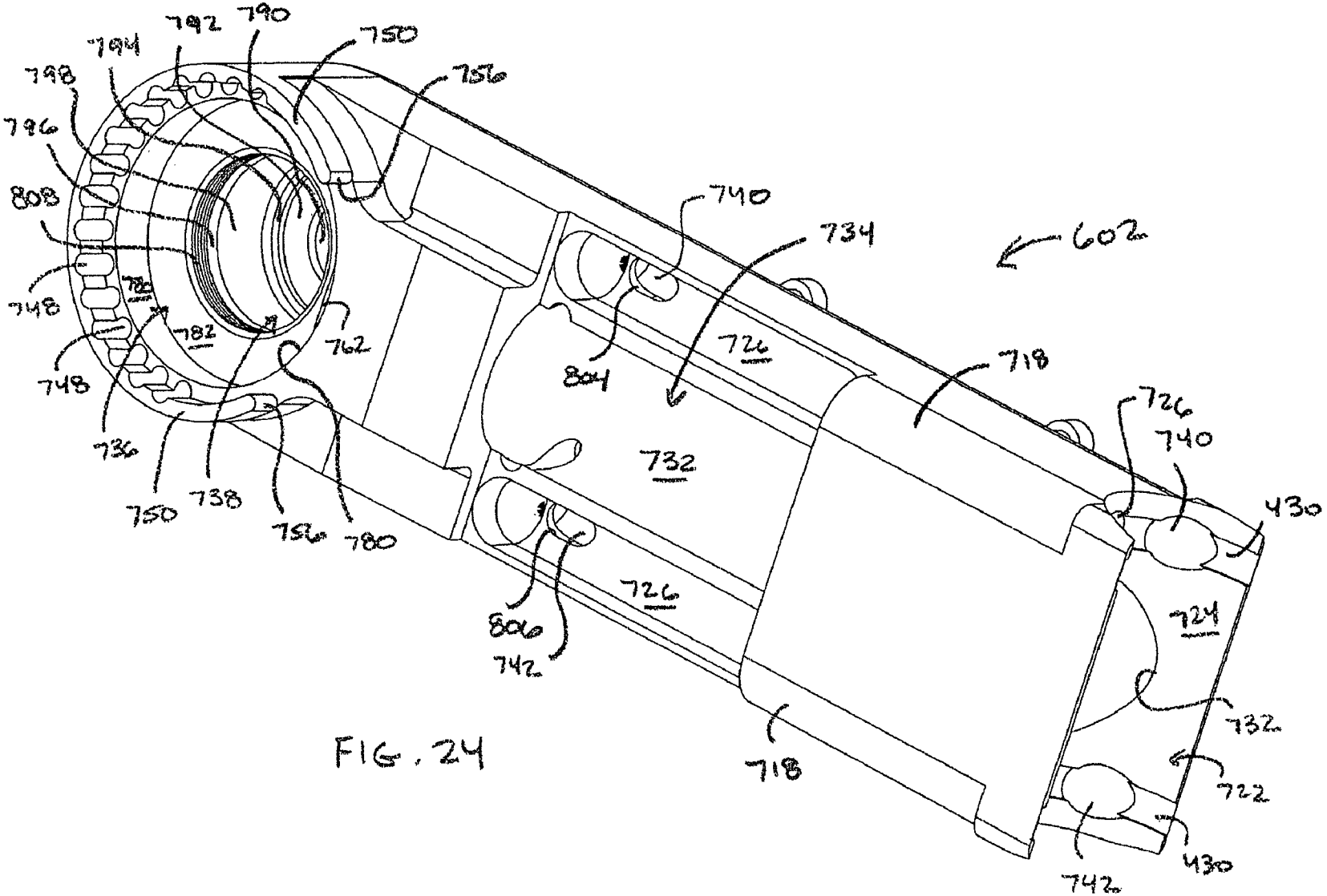
FIG. 24 is an isometric close-up bottom-side view of the disc housing of FIGS. 23A-23C viewed from the pivot end of the disc housing.
Figure 25:
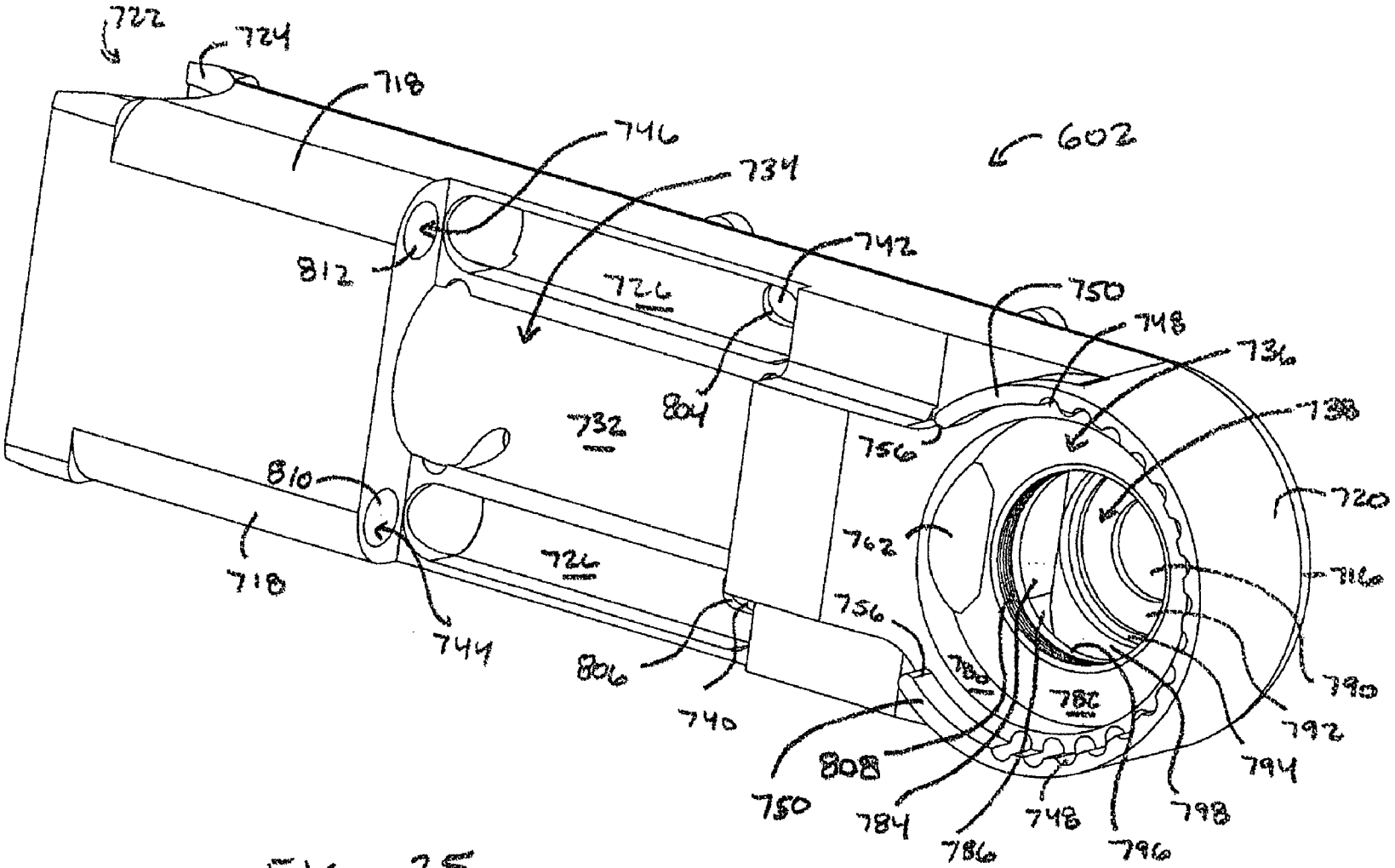
FIG. 25 is an isometric close-up bottom-side view of the disc housing of FIGS. 23A-23C viewed from the grinding end of the disc housing.

It should be noted that the lower portion 808 of bearing bore 796, below where lower bearing 664 resides in bearing bore 796, is threaded (see FIGS. 24 and 25). The threads are provided to receive bearing nut 610. Bearing nut 610 threads into the threaded portion 808 of bearing bore 796 to secure bevel gear drive shaft subassembly 612 in place inside of disc housing 602. The bottom side of bearing nut 610 includes four small keying holes 758. The four small keying holes are disposed to receive a third four (4) prong spanner wrench (not shown) that is used to install bearing nut 610 into disc housing 602.

As mentioned above, disc housing 602, like tool body 126, also includes a pair of vacuum ports 740, 742 and a pair of light source ports 744, 746 (see FIGS. 23A-23C). These various ports all run longitudinally through bit housing 602 and are disposed in-line, and in open alignment with, the corresponding vacuum and light source ports that exit coped pivot end 156 of tool body assembly 102 when equine dental tool 100 is completely assembled. For example, vacuum suction actually passes from vacuum ports 202, 204 of tool body assembly 102, through pivot joint 106, and into vacuum ports 740, 742 respectively to provide vacuum suction to disc housing assembly 600 in the vicinity of cutting disc 606. In a similar manner, split light source cables 246, 248 pass from light source ports 208, 210 of tool body assembly 102, through pivot joint 106, and into light source ports 744, 746 to provide a source of light to the disc end of dental tool 100.

Looking more closely at disc housing 602, it can be seen that vacuum ports 740, 742 do not extend all the way to vacuum chamber 738. Rather, it is the mounting screw passageways 726 that actually open into vacuum chamber 738. Passageways 726 open into vacuum chamber 738 via vacuum chamber openings 800 (see FIGS. 23A and 23C). A pair of transfer ports 804, 806 are provided between vacuum ports 740, 742 and passageways 726 to provide vacuum communication between vacuum ports 740, 742 and mounting screw passageways 726 in this embodiment.

The open ends 810, 812 of each light source port 744, 746 terminate at a point rearward of, and on either side of, bevel gear cavity 736 and thus also rearward of cutting disc 606. Unlike vacuum ports 740, 742, however, the open ends 810, 812 of light source ports 744, 746 are disposed on the outside of disc housing 602, not on the inside.

A clear lens 814 is installed in each open end 810, 812 of light source ports 744, 746 to prevent water or moisture from entering the light source ports. Lenses 814 are made from clear plastic acrylic rod that is sawed to the desired length and then machined to provide flat end surfaces. Each lens is then vapor polished to restore the clearness that is lost during the sawing and machining process.

When properly installed, each split light source cable 246, 248 terminates near the open end 810, 812 of its respective light source port 744, 746 just behind a lens 814. Thus, light from the ends of light source cables 246, 248 is provided from the open ends 810, 812 of light source ports 744, 746 though a lens 814 and shines on cutting disc 606 and onto the tooth being floated.

Figure 26A:
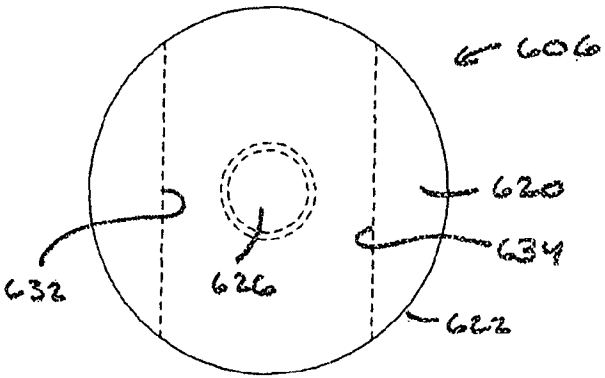
FIG. 26A is a bottom plan view of a cutting disc according to one embodiment of the present invention.
Figure 26B:
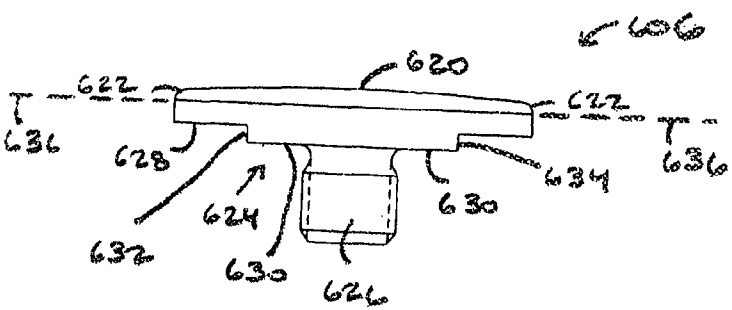
FIG. 26B is a side plan view of the cutting disc of FIG. 26A.
Figure 26C:
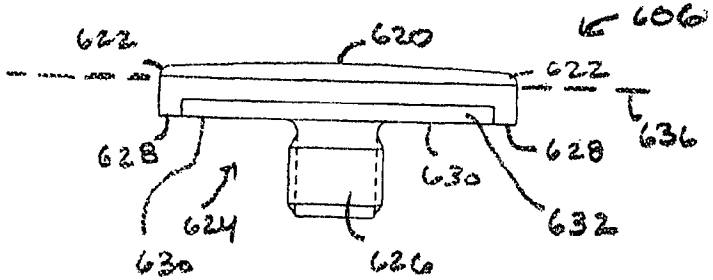
FIG. 26C is a rear end plan view of the cutting disc of FIG. 26A.

A cutting disc 606 according to one embodiment of the present invention is shown in FIG. 26A-26C and includes a domed circular bottom cutting surface 620 having a radiused circumferential bottom edge 622. The radius of curvature of domed cutting surface 620 is 5.6506 inches in the embodiment shown in FIGS. 26A-26C. Cutting surface 620 and radiused edge 622 are coated with a 24 grit diamond grinding medium in this embodiment.

Cutting disc 606 also includes a keyed top side 624 and a threaded center shaft 626. Keyed top side 624 includes a top surface 628 and a rectangular shaped land 630 that projects upward from top surface 628. Rectangular land 630 includes a pair of sidewall surfaces or shoulders 632, 634 that are disposed perpendicular to top surface 628 and thus perpendicular to the plane 636 of cutting disc 606.

Threaded center shaft 626 is provided to mount cutting disc 606 to bevel gear drive shaft subassembly 612. A thin specially configured open end wrench (not shown) is provided that mates with rectangular land 630 to facilitate installation and removal of cutting disc 606 as needed. Prongs on the wrench engage with shoulders 632, 634 to provide for such installation and/or removal.

It should be understood that the present invention is not limited to the particular type or configuration of cutting disc shown in FIGS. 26A-26C and in other embodiments of the present invention other types and configurations of cutting discs are used.

Assembly of disc housing assembly 600 will now be described in detail. As a starting point, fiber optic light port lenses 814 are inserted into the open ends 810, 812 of light source ports 744, 746 respectively. Lenses 814 are secured in place in open ends 810, 812 using a small bead of clear silicone sealant that is applied around the circumference of each lens prior to insertion into open ends 810, 812.

Next bevel gear drive shaft subassembly 612 is partially assembled. Bearings 662, 664 are pressed onto smooth upper spindle 672 of shaft 660 until the inner race of lower bearing 664 contacts bearing clearance shoulder 676. Next, bearing retainer 666 is placed concentrically about the threaded portion of bearing retainer screw 668 and bearing retainer screw 668 is threaded into threaded opening 678 in the end of spindle 672 until bearing retainer 666 contacts the inner race of bearing 662. A few drops of Loctite should be applied to the threads of bearing retainer screw 668 prior to its installation into spindle 672.

At this point, partially assembled bevel gear drive shaft subassembly 612 is inserted into vacuum chamber 738 such that the outer races of sealed bearings 662, 664 are lightly press fit into bearing bores 794, 796 respectively. In this position, the head of bearing retainer screw 668 should be disposed in clearance cavity 790 and the bottom edges of the inner and outer races of upper bearing 662 should be disposed in bearing race relief cavity 792.

The next step is to install bearing nut 610 into the threaded portion of lower bearing bore 796. It should be noted that the outside edge of bearing nut 610 includes right-hand threads that engage with the right-hand threads of bearing bore 796. Four keyed holes 758 are drilled though the top and bottom surfaces of bearing nut 610 to receive a four (4) key spanner wrench (not shown) that is used to thread bearing nut 610 into bearing bore 796. A few drops of Loctite should be applied to the threads on bearing nut 610 prior to its installation into bearing bore 796.

Properly installed, the bottom surface of bearing nut 610 is flush with the top wall surface 782 of bevel gear cavity 736 and the top surface of bearing nut 610 is in contact with the outer race of lower bearing 664. In this position, bearing nut 610 secures partially assembled bevel gear drive shaft subassembly 612 in place inside of vacuum chamber 738. Also in this position, the lower threaded shaft portion 674 of shaft 660 extends into bevel gear cavity 736 to receive bevel gear 670.

The next step is to install bevel gear 670 onto bevel gear drive shaft subassembly 612. High temperature and high pressure red grease is first applied to the teeth 690 of bevel gear 670. A small amount of Loctite is then applied to the threads on the inner bore 684 of bevel gear 670. Bevel gear 670 is then threaded onto lower shaft 674 of shaft 660 until it abuts up against shoulder stop 675 on shaft 660. As previously mentioned, the threads on the inner bore 684 of bevel gear 670 and on lower shaft 674 of shaft 660 are left-hand threads.

A four (4) key spanner wrench is used to engage the four key holes 682 that are disposed on the lower end of shaft 660 to prevent shaft 660 from rotating during installation of bevel gear 670. Likewise, a second larger four (4) key spanner wrench is used to engage the four key holes 688 that are disposed on the bottom of bevel gear 670 to facilitate installation of bevel gear 670 onto shaft 660. The smaller shaft spanner wrench is inserted through the larger bevel gear spanner wrench. The smaller shaft spanner wrench prevents shaft 660 from rotating while bevel gear 670 is being threaded onto shaft 660 using the larger spanner wrench.

With bevel gear 670 properly installed in bevel gear cavity 736, the next step is to install sealing washer 608 into bevel gear cavity 736 over sealing surface 677. Sealing washer 608 in this embodiment is a Teflon sealing washer that tightly press fits into bevel gear cavity 736. The bottom side of sealing washer 608 includes a raised ridge 428 that is provided to minimize the friction between sealing washer 608 and cutting disc 606 as cutting disc 606 rotates.

To properly install sealing washer 608 into bevel gear cavity 736, it is first desirable to cool sealing washer 608 in a freezer thereby causing it to shrink slightly. The cooled sealing washer is then pressed into bevel gear cavity 736 over protruding sealing surface 677 of shaft 660 such that the outer edge 822 of sealing washer 608 seals against the outer radial wall 780 of bevel gear cavity 736 and the inner edge surface 824 seals against sealing surface 677 of shaft 660. Over time, as sealing washer 608 returns to room temperature, it will expand slightly thus increasing its sealing performance. Any flash that is shaved off of edges 822 and 824 during installation should be removed from disc housing 602.

At this point, the next step is to assemble pinion gear drive shaft subassembly 614. First, bearing subassembly 704 is slid onto pinion shaft 706. Pinion shaft spacer 702 is then slid onto pinion shaft 706 and is positioned next to, and up against, the rear grooved end 434 of bearing subassembly 704. Drive socket 700 is slid onto the rear end or drive end of pinion shaft 706 until the rear end of pinion shaft 706 buts up against a shoulder (not shown) that is provided inside of drive socket 700. Drive socket 700 is secured in place on pinion shaft 706 using either a spring pin that passes through pinion shaft 706 or a set screw that engages pivot shaft 706. Finally, pinion gear 708 is slid all the way onto pinion shaft 706 until it abuts up against the forward end of bearing subassembly 704. Pinion gear 708 is attached to the front end of pinion shaft 706 and is secured in place using either a spring pin that passes through pinion shaft 706 or a set screw that engages with pinion shaft 706.

Fully assembled pinion gear drive shaft subassembly 614 is now partially inserted into pinion gear drive shaft opening 732 from rear curved pivot end surface 722 of disc housing 602 until the gear teeth 766 on pinion gear 708 couple with the gear teeth 690 on bevel gear 670 through drive engagement opening 762.

Cover plate 604 is now placed over cover plate opening 734 to align bearing subassembly 704 with curved recess 770 and alignment ridges 772. While holding cover plate 604 in place by hand, pinion drive shaft subassembly 614 should be rotated to check for proper meshing of pinion gear 708 with bevel gear 670. If the mesh is satisfactory, cover plate 604 is removed and disc housing 602 is attached to pivot tube 360 using the two mounting screws 730.

In general, the next step is to attach partially assembled disc housing assembly 600 to pivot joint 106 and to tool body assembly 102 in the same manner that bit housing assembly 104 is attached to pivot joint 106 and tool body assembly 102. As such, this portion of the assembly procedure will not be repeated here. Once this attachment is completed, cover plate 604 can be secured in place over cover plate opening 734 using the four mounting screws 830.

The final step in assembling equine dental tool 100 with disc housing assembly 600 is to install cutting disc 606. This is accomplished by first inserting a keyed wrench having a square shaft into square receptacle 354 in the end of drive cable adaptor 162. This prevents pinion gear drive shaft subassembly 614 and bevel gear drive shaft subassembly 612 from rotating during installation of cutting disc 606. With these two drive shafts restrained, threaded center shaft 624 of cutting disc 606 is hand threaded into threaded hole 680 in the end of bevel gear drive shaft subassembly 612 and is finger tightened.

A special thin open end type wrench (not shown) is inserted through rear access opening 756 in cutting disc guard 750 to engage with rectangular land 630 on the top keyed side of cutting disc 606. This is done to restrain cutting disc 606 during final installation. With cutting disc 606 restrained, cable adaptor 162 is rotated using the special keyed square wrench that is inserted into the end 354 of cable adaptor 162. Rotation of cable adaptor 162 causes pinion gear drive shaft subassembly 614 and bevel gear drive shaft subassembly 612 to rotate thereby tightening restrained cutting disc 606 on to the end of bevel gear drive shaft subassembly 612.

Disc housing assembly 600 is now fully assembled onto the end of equine dental tool 100 and tool 100 is ready for use.

As previously mentioned, disc housing assembly 600 is interchangeable with bit housing assembly 104 such that either assembly can be used with dental tool 100. As a result, disc housing assembly 600, like bit housing assembly 104, has the capability to pivot through a range of angles relative to elongated tool body assembly 102. For example, in one embodiment, disc housing assembly 600 has a range of motion of fourteen (14) degrees, seven (7) degrees upward (see angle 412 in FIG. 16) and seven (7) degrees downward (see angle 414 in FIG. 16).

In an alternative embodiment of the present invention, disc housing assembly 600 pivots as much as two and one-half (2.5) degrees upwards (angle 412) and eleven and one-half (11.5) degrees downward (angle 414). If a disc housing assembly having a shaft angle 426 of ninety (90) degrees is installed onto the end of dental tool 100 in this embodiment, the net angle of plane 636 of cutting disc 606 will also have a range of motion of two and one-half (2.5) degrees upwards and eleven and one-half (11.5) degrees downward. On the other hand, if a disc housing assembly having a shaft angle 426 of ninety four and one-half (94.5) degrees is installed onto the end of dental tool 100 in this embodiment, the net angle of plane 636 of cutting disc 606 will have an equal range of motion upwards and downwards (e.g., seven (7) degrees upward and seven (7) degrees downward).

It should be noted at this time that the particular range of pivot angles of two and one-half (2.5) degrees upwards and eleven and one-half (11.5) degrees downward was previously chosen, in combination with the included angle of tapered bit 262, to equalize the net upward and downward angle on the grinding surface of the tapered bit. By choosing an appropriate shaft angle 426 for interchangeable disc housing assembly 600, the same equalized net upwards and downwards angles can be achieved for the cutting surface of cutting disc 606.

It should be understood that the present invention is in no way limited to the specific pivot angles and pivot ranges described herein and those particular angles and ranges are for provided for illustrative purposes only. Other embodiments of the present invention will utilize other pivot angle ranges for bit housing assembly 104 and for disc housing assembly 600.

Numerous modifications may be made to the present invention which still fall within the intended scope hereof. Thus, it should be apparent that there has been provided in accordance with the present invention an apparatus and apparatus for grinding the teeth of horses that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An equine dental apparatus for floating the teeth of horses comprising:

a first drive shaft configured for attachment to a drive mechanism, wherein the first drive shaft rotates about a first axis;

a second drive shaft coupled to the first drive shaft and capable of rotating about a second axis different from the first axis, wherein the second drive shaft pivots relative to the first drive shaft about a third axis, and further wherein the third axis intersects the second axis;

a third drive shaft coupled to the second drive shaft, wherein the third drive shaft rotates about a fourth axis different from the first and second axes;

a grinding member attached to the third drive shaft, wherein the grinding member rotates about the fourth axis;

a first housing member, wherein the first drive shaft is disposed inside of the first housing member;

a second housing member, wherein the second drive shaft is disposed inside of the second housing member;

a pivot joint connecting the first housing member to the second housing member, wherein the second housing member pivots about the pivot joint relative to the first housing member; and a vacuum passageway at least partially disposed inside of the apparatus to provide vacuum suction in the vicinity of the grinding member to suction enamel dust produced during the floating of teeth, wherein the vacuum passageway passes through the pivot joint.

2. The equine dental apparatus of claim 1 wherein the apparatus further includes a source of illumination disposed to illuminate the teeth being floated, wherein the source of illumination is at least partially disposed inside of the first and second housing members.

3. The equine dental apparatus of claim 2 wherein the source of illumination passes through the pivot joint.

4. The equine dental apparatus of claim 2 wherein the source of illumination includes a cable, wherein the cable passes through the pivot joint.

5. The equine dental apparatus of claim 4 wherein the cable is a fiber optic cable.

6. The equine dental apparatus of claim 4 wherein the cable is a copper wire.

7. The equine dental apparatus of claim 1 wherein the pivot joint includes a ball and socket joint, wherein the second drive shaft is coupled to the first drive shaft via the ball and socket joint.

8. An equine dental apparatus for floating the teeth of horses comprising:

a first drive shaft configured for attachment to a drive mechanism, wherein the first drive shaft rotates about a first axis;

a second drive shaft coupled to the first drive shaft and capable of rotating about a second axis different from the first axis, wherein the second drive shaft pivots relative to the first drive shaft about a third axis, and further wherein the third axis intersects the second axis;

a ball and socket joint, wherein the first drive shaft is coupled to the second drive shaft via the ball and socket joint;

a third drive shaft coupled to the second drive shaft, wherein the third drive shaft rotates about a fourth axis different from the first and second axes;

a grinding member attached to the third drive shaft, wherein the grinding member rotates about the fourth axis;

a first housing member, wherein the first drive shaft is disposed inside of the first housing member;

a second housing member, wherein the second drive shaft is disposed inside of the second housing member;

a pivot joint connecting the first housing member to the second housing member, wherein the second housing member pivots about the pivot joint relative to the first housing member; and a vacuum passageway at least partially disposed inside of the apparatus to provide vacuum suction in the vicinity of the grinding member to suction enamel dust produced during the floating of teeth.

9. The equine dental apparatus of claim 8 wherein the apparatus further includes a source of illumination disposed to illuminate the teeth being floated.

10. The equine dental apparatus of claim 9 wherein the source of illumination is at least partially disposed inside of the apparatus.

11. The equine dental apparatus of claim 9 wherein the source of illumination is at least partially disposed inside of the first and second housing members.

12. The equine dental apparatus of claim 9 wherein the source of illumination passes through the pivot joint.

13. The equine dental apparatus of claim 12 wherein the source of illumination includes a cable, wherein the cable passes through the pivot joint.

14. The equine dental apparatus of claim 13 wherein the cable is a fiber optic cable.

15. The equine dental apparatus of claim 13 wherein the cable is a copper wire.

16. An equine dental apparatus for floating the teeth of horses comprising:

a first drive shaft configured for attachment to a drive mechanism, wherein the first drive shaft rotates about a first axis;

a second drive shaft coupled to the first drive shaft and capable of rotating about a second axis different from the first axis, wherein the second drive shaft pivots relative to the first drive shaft about a third axis, and further wherein the third axis intersects the second axis;

a ball and socket joint, wherein the first drive shaft is coupled to the second drive shaft via the ball and socket joint;

a third drive shaft coupled to the second drive shaft, wherein the third drive shaft rotates about a fourth axis different from the first and second axes;

a grinding member attached to the third drive shaft, wherein the grinding member rotates about the fourth axis; and a vacuum passageway at least partially disposed inside of the apparatus to provide vacuum suction in the vicinity of the grinding member to suction enamel dust produced during the floating of teeth.

17. The equine dental apparatus of claim 16 wherein the apparatus further includes a source of illumination disposed to illuminate the teeth being floated.

18. The equine dental apparatus of claim 17 wherein the source of illumination is at least partially disposed inside of the apparatus.

19. An equine dental apparatus for floating the teeth of horses comprising:

a first housing member disposed along a first longitudinal axis and configured for attachment to a drive system;

a second housing member disposed along a second longitudinal axis;

a pivot joint having a pivot axis perpendicular to the first longitudinal axis, wherein the pivot joint connects the first housing member to the second housing member, and further wherein the second housing member pivots about the pivot axis relative to the first housing member;

a grinding member partially disposed inside of the second housing member, wherein the grinding member rotates about a fourth axis different from the first and second longitudinal axes; and a vacuum passageway at least partially disposed inside of the apparatus to provide vacuum suction in the vicinity of the grinding member to suction enamel dust produced during the floating of teeth, wherein the vacuum passageway passes through the pivot joint.

20. The equine dental apparatus of claim 19 wherein the apparatus further includes a source of illumination disposed to illuminate the teeth being floated, wherein the source of illumination is at least partially disposed inside of the first and second housing members.

21. The equine dental apparatus of claim 20 wherein the source of illumination passes through the pivot joint.

22. The equine dental apparatus of claim 20 wherein the source of illumination includes a cable, wherein the cable passes through the pivot joint.

23. The equine dental apparatus of claim 22 wherein the cable is a fiber optic cable.

24. The equine dental apparatus of claim 22 wherein the cable is a copper wire.

25. An equine dental apparatus for floating the teeth of horses comprising:

a tool body;

a first drive shaft disposed inside of the tool body, wherein the first drive shaft includes a first end configured for attachment to a drive mechanism and a second end opposite the first end, wherein the first drive shaft rotates about a first axis;

a first grinding head configured for attachment to the tool body, wherein the first grinding head includes a second drive shaft and a first grinding member, wherein the second drive shaft rotates about a second axis and has a first end capable of coupling to the second end of the first drive shaft and a second end, wherein the first grinding member is attached to the second end of the second drive shaft, and further wherein the first grinding member rotates about the second axis; and a second grinding head configured for attachment to the tool body, wherein the second grinding head includes a third drive shaft, a fourth drive shaft, and a second grinding member, wherein the third drive shaft rotates about a third axis and has a first end capable of coupling to the second end of the first drive shaft and a second end, wherein the fourth drive shaft rotates about a fourth axis different from the third axis and has a first end coupled to the second end of the third drive shaft and a second end, wherein the grinding member is attached to the second end of the fourth drive shaft, and further wherein the grinding member rotates about the fourth axis.

26. The equine dental apparatus of claim 25 further comprising a pivot joint disposed to connect a selective one of the first and second grinding heads to the tool body, wherein the selected one of the first and second grinding heads when connected pivots about the pivot joint relative to the tool body.

27. The equine dental apparatus of claim 26 wherein the appartus further includes a vacuum passageway disposed to suction enamel dust produced during the floating of teeth, wherein a portion of the vacuum passageway is disposed inside of the tool body, and further wherein the vacuum passageway passes through the pivot joint.

28. The equine dental apparatus of claim 26 wherein the apparatus further includes a source of illumination disposed to illuminate the teeth being floated, wherein the source of illumination is at least partially disposed inside of the tool body.

29. The equine dental apparatus of claim 28 wherein the source of illumination passes through the pivot joint.

30. The equine dental apparatus of claim 25 wherein the apparatus further includes a vacuum passageway disposed to suction enamel dust produced during the floating of teeth.

31. The equine dental apparatus of claim 30 wherein a portion of the vacuum passageway is disposed inside of the tool body.

32. The equine dental apparatus of claim 25 wherein the apparatus further includes a source of illumination disposed to illuminate the teeth being floated.

33. The equine dental apparatus of claim 32 wherein the source of illumination is at least partially disposed inside of the tool body.

34. An equine dental apparatus for floating the teeth of horses comprising:

a first drive shaft configured for attachment to a drive mechanism, wherein the first drive shaft rotates about a first axis;

a second drive shaft coupled to the first drive shaft and capable of rotating about a second axis different from the first axis, wherein the second drive shaft pivots relative to the first drive shaft about a third axis, and further wherein the third axis intersects the second axis;

a third drive shaft coupled to the second drive shaft, wherein the third drive shaft rotates about a fourth axis different from the first and second axes;

a grinding member attached to the third drive shaft, wherein the grinding member rotates about the fourth axis;

a first housing member, wherein the first drive shaft is disposed inside of the first housing member;

a second housing member, wherein the second drive shaft is disposed inside of the second housing member;

a pivot joint connecting the first housing member to the second housing member, wherein the second housing member pivots about the pivot joint relative to the first housing member, wherein the pivot joint comprises a cylindrical member having first and second opposing ends, wherein the second housing member is fixedly attached to the cylindrical member, and further wherein the cylindrical member is disposed for rotation about the third axis, and first and second circular end members, wherein the first and second circular end members are rotationally disposed inside of the first and second opposing ends respectively of the cylindrical member such that the first and second circular end members are capable of rotating about the third axis independent of the cylindrical member, and further wherein the first housing member is fixedly attached to the first and second circular end members; and a vacuum passageway at least partially disposed inside of the apparatus to provide vacuum suction in the vicinity of the grinding member to suction enamel dust produced during the floating of teeth.

35. The equine dental apparatus of claim 34 wherein the pivot joint further includes a ball and socket joint disposed inside of the cylindrical member.

36. The equine dental apparatus of claim 34 wherein the vacuum passageway passes through the cylindrical member.

37. The equine dental apparatus of claim 34 wherein the vacuum passageway passes through a portion of at least one of the first or second circular end members.

38. The equine dental apparatus of claim 34 wherein the apparatus further includes a source of illumination disposed to illuminate the teeth being floated.

39. The equine dental apparatus of claim 38 wherein the source of illumination is at least partially disposed inside of the apparatus.

40. The equine dental apparatus of claim 38 wherein the source of illumination is at least partially disposed inside of the first and second housing members.

41. The equine dental apparatus of claim 38 wherein the source of illumination passes through the pivot joint.

42. The equine dental apparatus of claim 41 wherein the source of illumination includes a cable, wherein the cable passes through the pivot joint.

43. The equine dental apparatus of claim 42 wherein the cable is a fiber optic cable.

44. The equine dental apparatus of claim 41 wherein the source of illumination passes through the cylindrical member.

45. An equine dental apparatus for floating the teeth of horses comprising:

a first housing member disposed along a first longitudinal axis and configured for attachment to a drive system;

a second housing member disposed along a second longitudinal axis;

a pivot joint having a pivot axis perpendicular to the first longitudinal axis, wherein the pivot ioint connects the first housing member to the second housing member, and further wherein the second housing member pivots about the pivot axis relative to the first housing member, wherein the pivot joint comprises a cylindrical member having first and second opposing ends, wherein the second housing member is fixedly attached to the cylindrical member, and further wherein the cylindrical member is disposed for rotation about the pivot axis, and first and second circular end members, wherein the first and second circular end members are rotationally disposed inside of the first and second opposing ends respectively of the cylindrical member such that the first and second circular end members are capable of rotating about the pivot axis independent of the cylindrical member, and further wherein the first housing member is fixedly attached to the first and second circular end members;

a grinding member partially disposed inside of the second housing member, wherein the grinding member rotates about a fourth axis different from the first and second longitudinal axes; and a vacuum passageway at least partially disposed inside of the apparatus to provide vacuum suction in the vicinity of the grinding member to suction enamel dust produced during the floating of teeth.

46. The equine dental apparatus of claim 45 wherein the pivot joint further includes a ball and socket joint disposed inside of the cylindrical member.

47. The equine dental apparatus of claim 45 wherein the vacuum passageway passes through the cylindrical member.

48. The equine dental apparatus of claim 45 wherein the vacuum passageway passes through a portion of at least one of the first or second circular end members.

49. The equine dental apparatus of claim 45 wherein the apparatus further includes a source of illumination disposed to illuminate the teeth being floated.

50. The equine dental apparatus of claim 49 wherein the source of illumination is at least partially disposed inside of the apparatus.

51. The equine dental apparatus of claim 49 wherein the source of illumination is at least partially disposed inside of the first and second housing members.

52. The equine dental apparatus of claim 49 wherein the source of illumination passes through the pivot joint.

53. The equine dental apparatus of claim 52 wherein the source of illumination includes a cable, wherein the cable passes through the pivot joint.

54. The equine dental apparatus of claim 53 wherein the cable is a fiber optic cable.

55. The equine dental apparatus of claim 52 wherein the source of illumination passes through the cylindrical member.

* * * * *